US009970722B1

(12) United States Patent
Babb

(10) Patent No.: US 9,970,722 B1
(45) Date of Patent: May 15, 2018

(54) RECOIL BUFFER SYSTEM

(71) Applicant: Battle Arms Development, Inc., Henderson, NV (US)

(72) Inventor: Matthew Babb, Henderson, NV (US)

(73) Assignee: Battle Arms Development, Inc., Henderson, NV (US)

( * ) Notice: Subject to any disclaimer, the term of this patent is extended or adjusted under 35 U.S.C. 154(b) by 188 days.

(21) Appl. No.: 14/996,189

(22) Filed: Jan. 14, 2016

(51) Int. Cl.
*F41A 3/82* (2006.01)

(52) U.S. Cl.
CPC ..... *F41A 3/82* (2013.01)

(58) Field of Classification Search
CPC ..... F41A 3/82; F41A 3/84; F41A 3/78; F41A 3/80; F41A 3/86; F41A 25/10; F41A 25/12; F41C 23/06; F41C 23/08
USPC ..... 42/1.06, 74, 71.01, 72; 89/198
See application file for complete search history.

(56) References Cited

U.S. PATENT DOCUMENTS 2,504,958 A * 4/1950 Botts ..... F41A 25/14 89/198
6,829,974 B1 12/2004 Gwinn, Jr.
7,478,495 B1 1/2009 Alzamora et al.
8,943,947 B2 2/2015 Gomez
9,080,823 B1 * 7/2015 Mantas ..... F41A 25/12
9,341,437 B1 5/2016 Huang
2005/0246931 A1 * 11/2005 Poff, Jr. ..... F41C 23/06 42/1.06
2006/0236853 A1 10/2006 Boerschlng et al.
2010/0050492 A1 3/2010 Faifer
2010/0251588 A1 10/2010 Kincel
2013/0182114 A1 8/2013 Christenson
2013/0319217 A1 12/2013 Gangl et al.
2014/0059909 A1 3/2014 Caudle
2015/0192380 A1 7/2015 Hilsabeck

OTHER PUBLICATIONS http://shop.hilsabeckfirearms.com/Flatline-000001.htm.

* cited by examiner

*Primary Examiner* — Reginald Tillman, Jr.
(74) *Attorney, Agent, or Firm* — Shaddock Law Group, PC

(57) ABSTRACT

A recoil buffer system having a buffer element, wherein the buffer element extends from a first buffer element end to a second buffer element end; a shoulder extending from a portion of the buffer element; a spacer, wherein the spacer extends from a first spacer end to a second spacer end, wherein the spacer is slidable along at least a portion of the buffer element; a first recoil spring, wherein the first recoil spring extends from a first end of the first recoil spring to a second end of the first recoil spring; and a second recoil spring, wherein the second recoil spring is positioned between the shoulder and the first spacer end of the spacer, and wherein the first recoil spring is positioned such that a first end of the first recoil spring is abutted against and extends from the second spacer end of the spacer.

20 Claims, 18 Drawing Sheets

RECOIL BUFFER SYSTEM

CROSS-REFERENCE TO RELATED APPLICATIONS

None.

STATEMENT REGARDING FEDERALLY SPONSORED RESEARCH OR DEVELOPMENT

Not Applicable.

REFERENCE TO SEQUENCE LISTING, A TABLE, OR A COMPUTER PROGRAM LISTING DISC APPENDIX

Not Applicable.

NOTICE OF COPYRIGHTED MATERIAL

The disclosure of this patent document contains material that is subject to copyright protection. The copyright owner has no objection to the reproduction by anyone of the patent document or the patent disclosure, as it appears in the Patent and Trademark Office patent file or records, but otherwise reserves all copyright rights whatsoever. Unless otherwise noted, all trademarks and service marks identified herein are owned by the applicant.

BACKGROUND OF THE INVENTION

1. Field of the Invention

The present disclosure relates generally to the field of firearms. More specifically, the present disclosure relates to a recoil buffer system for a firearm.

2. Description of Related Art

The AR-15 is based on the AR-10, which was designed by Eugene Stoner, Robert Fremont, and L. James Sullivan of the Fairchild ArmaLite Corporation in 1957. Today, there are numerous variants of the AR-15 that are manufactured by a number of companies. The AR-15 and its various related derivative platforms are used by civilians, law enforcement personnel, and military forces around the world.

Various firearms, such as, for example, the AR-15 or M-4 style firearms utilize a variable position buttstock 2 that is slidable and lockable at various positions along a buffer tube 5. A typical variable position buttstock 2 can be locked into a collapsed position, as illustrated in FIG. 1, or locked into a fully extended position, as illustrated in FIG. 2.

As further illustrated in FIGS. 3 and 4, the typical buffer tube 2 includes a capped cylindrical portion having a threaded portion 8 for installation into a buffer tube receiving aperture 11 of a lower receiver 10. Typically, an endplate 6 and a lock ring 4 are utilized to complete installation of the buffer tube 5 on the receiver. A key protrusion 7 extends from the cylindrical portion 9, typically at the 6 o'clock position. An interior portion of the key protrusion includes a plurality of spaced apart recesses or apertures that interact with a retractable bolt to lock the buttstock 2 in a desired position relative to the buffer tube 5.

During normal operation of a semiautomatic AR-15 style rifle, when a round is fired, gas from the burning propellant forces the bullet through the barrel. Before the bullet leaves the barrel, a portion of the gas enters a gas port in the upper part of the barrel under the front sight (or gas block). The gas port directs gas through a portion of the front sight (or gas block) and into the gas tube, which directs the gas into a cylinder between the bolt carrier 13 and the bolt and drives the bolt carrier 13 rearward.

The buffer, which is pushing on the rear of the bolt carrier group, is forced rearward by the bolt carrier group, compressing the recoil spring. During this rearward movement, a cam track in the upper portion of the bolt carrier 13 acts on the bolt cam pin, rotating the cam pin and bolt clockwise so that the bolt locking lugs are unlocked from the barrel extension locking lugs. As the rearward movement of the bolt carrier group continues, the empty cartridge case is extracted from the chamber, and ejected through the ejection port.

As the bolt carrier group clears the top of an inserted magazine and the empty cartridge case is expelled, a new round is pushed into the path of the bolt by the upward thrust of the magazine follower and spring.

As the bolt carrier group continues to move rearward, it overrides the hammer and forces the hammer down into the receiver, compressing the hammer spring, and allowing the rear hook of the hammer to engage with the hammer disconnect.

When the bolt carrier group reaches its rearmost position (when the rear of the buffer contacts the bottom wall at the rear of the buffer tube 5), the compressed recoil spring expands, driving the buffer assembly forward with enough force to drive the bolt carrier group forward, toward the chamber, initiating chambering of the waiting round from the magazine into the chamber.

The forward movement of the bolt ceases when the locking lugs pass between the barrel extension locking lugs and the round is fully chambered. When the bolt carrier 13 enters the final portion of its forward movement, the bolt cam pin emerges from the cam pin guide channel in the upper receiver and moves along the cam track, rotating the bolt counterclockwise. This rotation locks the bolt to the barrel extension (by interaction of the bolt locking lugs and the barrel extension locking lugs). The locking of the bolt completes the cycle of operation and, when the trigger is released, the rear hammer hook hammer slips from the disconnect and the front hammer hook is caught by the sear of the trigger. The firearm is then ready to be fired again.

Any discussion of documents, acts, materials, devices, articles, or the like, which has been included in the present specification is not to be taken as an admission that any or all of these matters form part of the prior art base or were common general knowledge in the field relevant to the present disclosure as it existed before the priority date of each claim of this application.

BRIEF SUMMARY OF THE INVENTION

Among other things, known recoil buffer systems utilize a single, elongate buffer recoil spring that interacts with the rear of the bolt carrier 13 (during the firing cycle). This results in known recoil buffer systems that cannot be adjusted or "tuned" to adjust the actual or perceived to recoil or the cyclic rate of the firearm.

The disadvantages and shortcomings of the prior art are overcome by the features and elements of the recoil buffer system of the present disclosure. The advantages of the present disclosure are preferably attained by providing, in at least one exemplary, nonlimiting embodiment, a recoil buffer system, comprising a first recoil spring, wherein the first recoil spring extends from a first end of the first recoil spring to a second end of the first recoil spring; a second recoil spring, wherein the second recoil spring extends from a first end of the second recoil spring to a second end of the second recoil spring; a buffer element, wherein the buffer element extends from a first buffer element end to a second buffer element end, wherein the buffer element includes a collar cavity extending from the first buffer element end, wherein an internally threaded portion extends from the collar cavity, wherein the internally threaded portion is internally threaded so as to interact with external threads of a shoulder bolt, such that interaction of the external threads of the shoulder bolt and the threaded portion of the internally threaded portion allow the shoulder bolt to be threadedly attached or connected to the buffer element; a spacer, wherein the spacer extends from a first spacer end to a second spacer end, wherein the spacer comprises a spacer aperture formed therethrough, where the spacer aperture is formed so as to accept at least a portion of the buffer element therein, such that the spacer is slidable along at least a portion of the buffer element, and wherein the first spacer end and the second spacer end provide abutment surfaces for the first recoil spring and the second recoil spring; and a collar, wherein the collar extends from a first collar end to a second collar end, wherein a collar aperture is formed through the collar, wherein the collar aperture is formed so as to accept at least a portion of the shoulder bolt therein, such that the collar is slidable along at least a portion of a shaft of the shoulder bolt, wherein a collar body head portion extends from a first portion of a central collar body portion and a collar body extension portion extends from a second portion of the central collar body portion, wherein the collar body head portion has an outer diameter or shape that is greater than an outer diameter or shape of the collar body portion, wherein a collar shoulder extends between an outer surface of the collar body head portion and an outer surface of the collar body portion, wherein the collar shoulder is sized and shaped so as to provide an abutment surface for the second end of the second recoil spring, while the central collar body portion is sized and shaped so as to be at least partially fitted within the second recoil spring, wherein the collar body extension portion has an outer diameter or shape that is less than an outer diameter or shape of the collar body portion, wherein the collar body extension portion is formed so as to be at least partially slidably received within the collar cavity of the buffer element, and wherein a collar extension shoulder extends between and outer surface of the collar body extension portion and the outer surface of the collar body portion, wherein a collar recess extends from the first collar end, wherein the collar recess has a diameter that is greater than a diameter of the collar aperture, and wherein the collar recess is formed so as to accept at least a portion of a head of the shoulder bolt therein.

In still other exemplary, nonlimiting embodiments, a recoil buffer system is provided that comprises a buffer element, wherein the buffer element extends from a first buffer element end to a second buffer element end; a collar, wherein a collar shoulder extends from a portion of the collar, and wherein the collar is attached or coupled to the first buffer element end; a spacer, wherein the spacer extends from a first spacer end to a second spacer end, wherein the spacer is slidable along at least a portion of the buffer element; a first recoil spring, wherein the first recoil spring extends from a first end of the first recoil spring to a second end of the first recoil spring; and a second recoil spring, wherein the second recoil spring is positioned between the collar shoulder of the collar and the first spacer end of the spacer, and wherein the first recoil spring is positioned such that a first end of the first recoil spring is abutted against and extends from the second spacer end of the spacer.

In still other exemplary, nonlimiting embodiments, a recoil buffer system is provided that comprises a buffer element, wherein the buffer element extends from a first buffer element end to a second buffer element end; a shoulder extending from a portion of the buffer element; a spacer, wherein the spacer extends from a first spacer end to a second spacer end, wherein the spacer is slidable along at least a portion of the buffer element; a first recoil spring, wherein the first recoil spring extends from a first end of the first recoil spring to a second end of the first recoil spring; and a second recoil spring, wherein the second recoil spring is positioned between the shoulder and the first spacer end of the spacer, and wherein the first recoil spring is positioned such that a first end of the first recoil spring is abutted against and extends from the second spacer end of the spacer.

Accordingly, in certain exemplary, nonlimiting embodiments, the presently disclosed systems, methods, and/or apparatuses provide a recoil buffer system that utilizes a first recoil spring and a second recoil spring.

In certain exemplary, nonlimiting embodiments, the presently disclosed systems, methods, and/or apparatuses may optionally separately provide a recoil buffer system that can be utilized in conjunction with a standard bolt carrier.

In certain exemplary, nonlimiting embodiments, the presently disclosed systems, methods, and/or apparatuses may optionally separately provide a recoil buffer system that utilizes various components of the buffer assembly as part of a reciprocating mass.

In certain exemplary, nonlimiting embodiments, the presently disclosed systems, methods, and/or apparatuses may optionally separately provide a recoil buffer system that provides a "dead below" effect.

In certain exemplary, nonlimiting embodiments, the presently disclosed systems, methods, and/or apparatuses may optionally separately provide a recoil buffer system that allows a recoil buffer system that can be "tuned".

In certain exemplary, nonlimiting embodiments, the presently disclosed systems, methods, and/or apparatuses may optionally separately provide a recoil buffer system that provides the same dampening effect to the recoil system as a heavier buffer.

In certain exemplary, nonlimiting embodiments, the presently disclosed systems, methods, and/or apparatuses may optionally separately provide a recoil buffer system that can be easily assembled and/or retrofitted by a user.

These and other aspects, features, and advantages of the present disclosure are described in or are apparent from the following detailed description of the exemplary, non-limiting embodiments of the present disclosure and the accompanying figures. Other aspects and features of embodiments of the present disclosure will become apparent to those of ordinary skill in the art upon reviewing the following description of specific, exemplary embodiments of the present disclosure in concert with the figures. While features of the present disclosure may be discussed relative to certain embodiments and figures, all embodiments of the present disclosure can include one or more of the features discussed herein. Further, while one or more embodiments may be discussed as having certain advantageous features, one or more of such features may also be used with the various embodiments of the systems, methods, and/or apparatuses discussed herein. In similar fashion, while exemplary embodiments may be discussed below as device, system, or method embodiments, it is to be understood that such exemplary embodiments can be implemented in various devices, systems, and methods of the present disclosure.

Any benefits, advantages, or solutions to problems that are described herein with regard to specific embodiments are not intended to be construed as a critical, required, or essential feature(s) or element(s) of the present disclosure or the claims.

BRIEF DESCRIPTION OF THE SEVERAL VIEWS OF THE DRAWINGS

As required, detailed exemplary embodiments of the present disclosure are disclosed herein; however, it is to be understood that the disclosed embodiments are merely exemplary of the systems, methods, and/or apparatuses that may be embodied in various and alternative forms, within the scope of the present disclosure. The figures are not necessarily to scale; some features may be exaggerated or minimized to illustrate details of particular components. Therefore, specific structural and functional details disclosed herein are not to be interpreted as limiting, but merely as a basis for the claims and as a representative basis for teaching one skilled in the art to employ the present disclosure.

The exemplary embodiments of the presently disclosed systems, methods, and/or apparatuses will be described in detail, with reference to the following figures, wherein like reference numerals refer to like parts throughout the several views, and wherein.

DETAILED DESCRIPTION OF THE INVENTION

Figure 1:
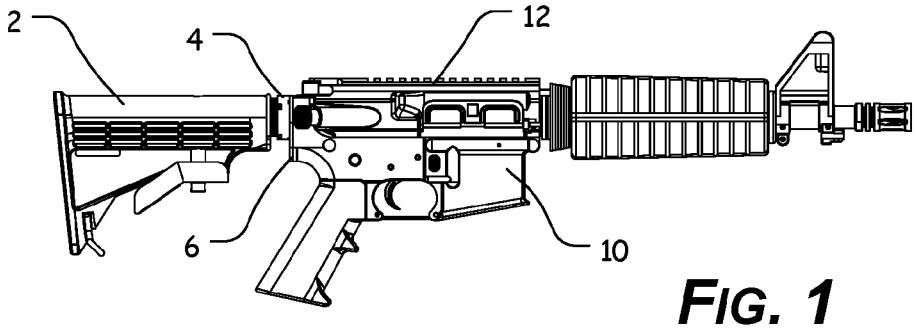
FIG. 1 PRIOR ART
FIG. 1 illustrates a side view of a standard, AR-15 or M4 style rifle having a collapsible buttstock, shown in a collapsed position relative to a standard buffer tube.
Figure 2:
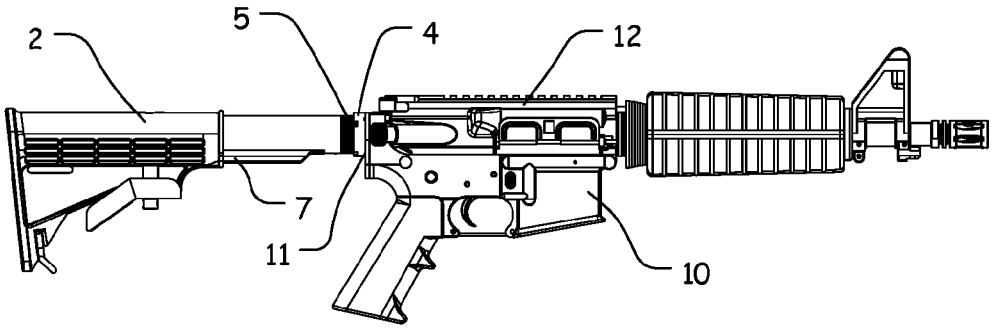
FIG. 2 PRIOR ART
FIG. 2 illustrates a side view of a standard, AR-15 or M4 style rifle having a collapsible buttstock, shown in an extended position relative to a standard buffer tube.
Figure 3:
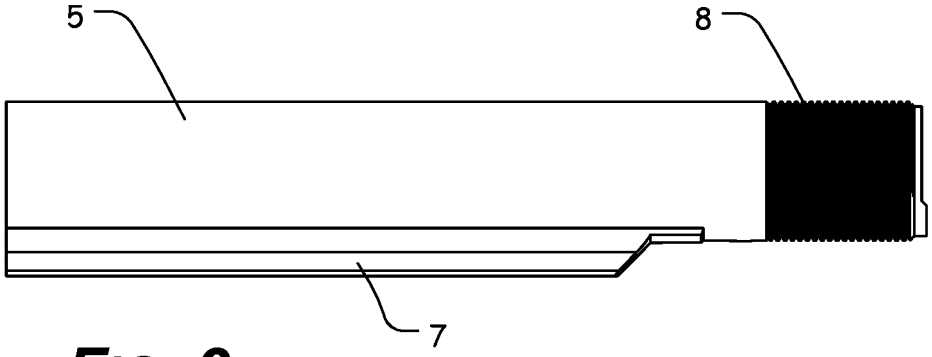
FIG. 3 PRIOR ART
FIG. 3 illustrates a side view of a standard buffer tube.
Figure 4:
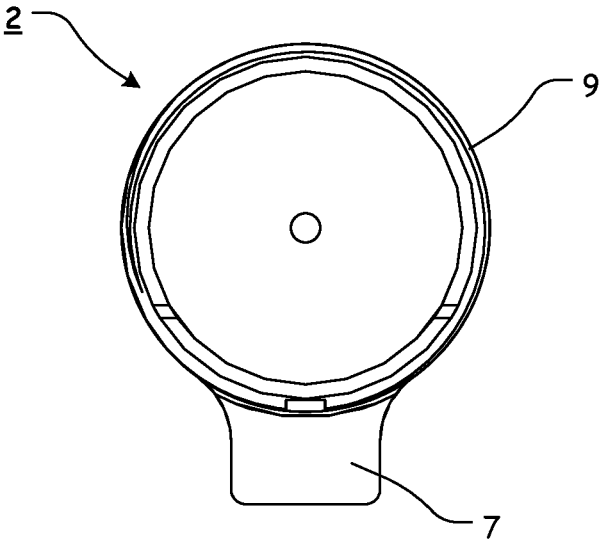
FIG. 4 PRIOR ART
FIG. 4 illustrates a front view of a standard buffer tube.
Figure 5:
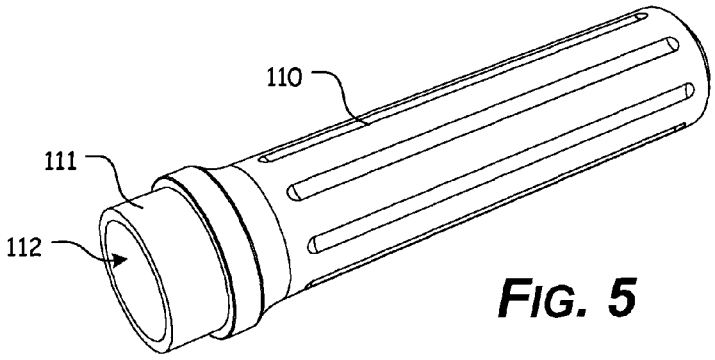
FIG. 5 illustrates an upper, front perspective view of an exemplary embodiment of a buffer tube that may optionally be utilized in connection with the presently disclosed systems, methods, and/or apparatuses.
Figure 6:
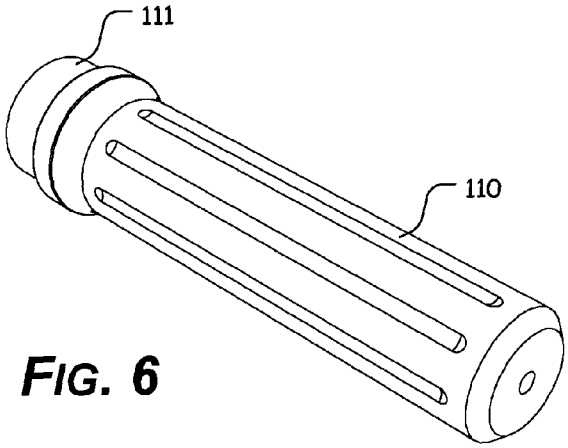
FIG. 6 illustrates an upper, rear perspective view of an exemplary embodiment of a buffer tube that may optionally be utilized in connection with the presently disclosed systems, methods, and/or apparatuses.
Figure 7:
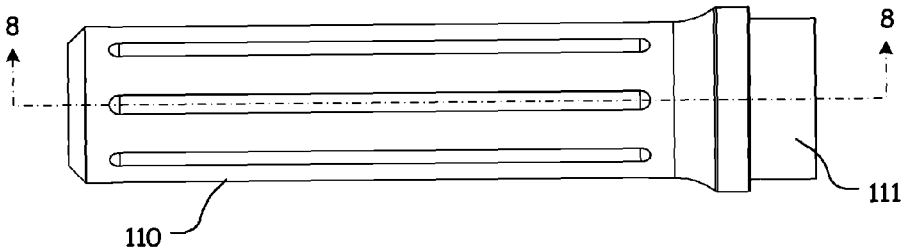
FIG. 7 illustrates a side view of an exemplary embodiment of a buffer tube that may optionally be utilized in connection with the presently disclosed systems, methods, and/or apparatuses.
Figure 8:
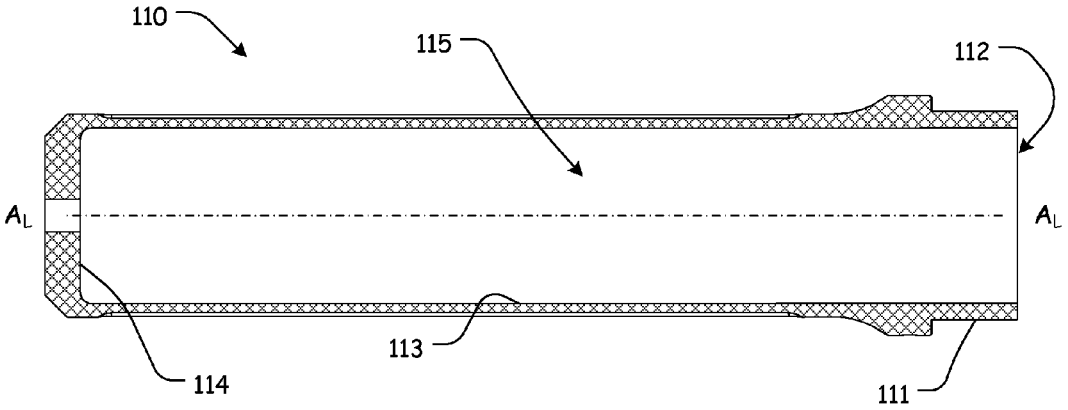
FIG. 8 illustrates a side cross-sectional view taken along line 8-8 of the buffer tube of FIG. 7.
Figure 9:
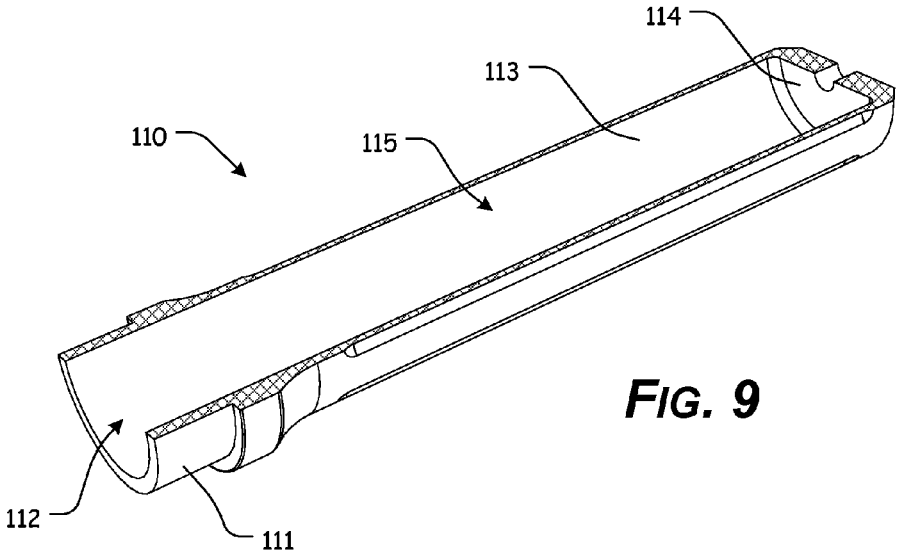
FIG. 9 illustrates a perspective cross-sectional view taken along line 8-8 of the buffer tube of FIG. 7.
Figure 10:
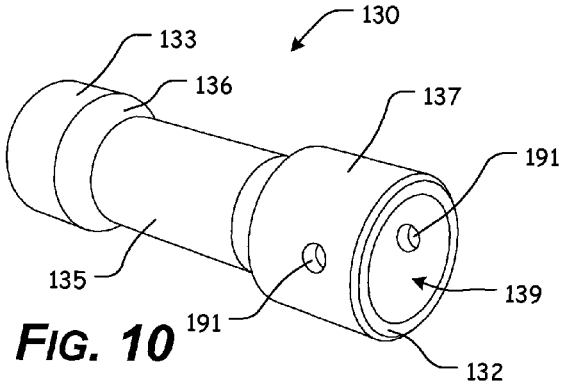
FIG. 10 illustrates an upper, rear perspective view of an exemplary embodiment of a buffer element, according to the presently disclosed systems, methods, and/or apparatuses.
Figure 11:
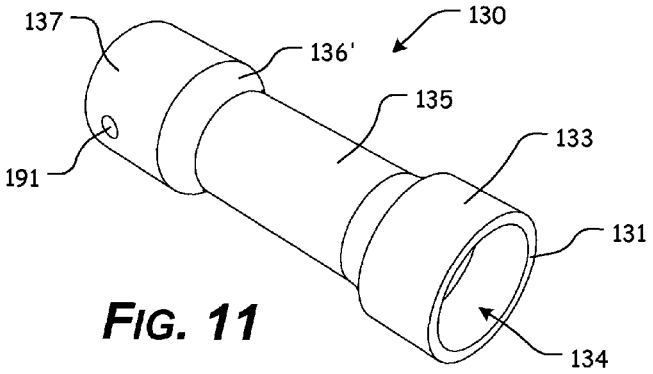
FIG. 11 illustrates an upper, front perspective view of an exemplary embodiment of a buffer element, according to the presently disclosed systems, methods, and/or apparatuses.
Figure 12:
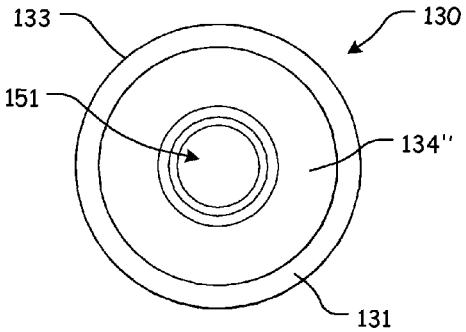
FIG. 12 illustrates a front view of an exemplary embodiment of a buffer element, according to the presently disclosed systems, methods, and/or apparatuses.
Figure 13:
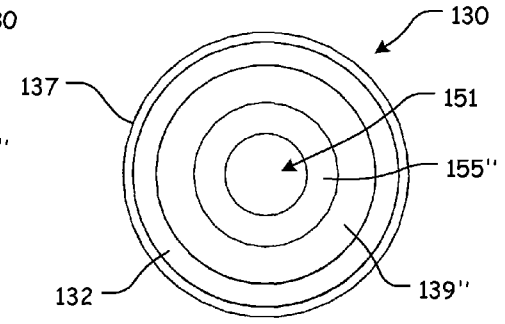
FIG. 13 illustrates a rear view of an exemplary embodiment of a buffer element, according to the presently disclosed systems, methods, and/or apparatuses.
Figure 14:
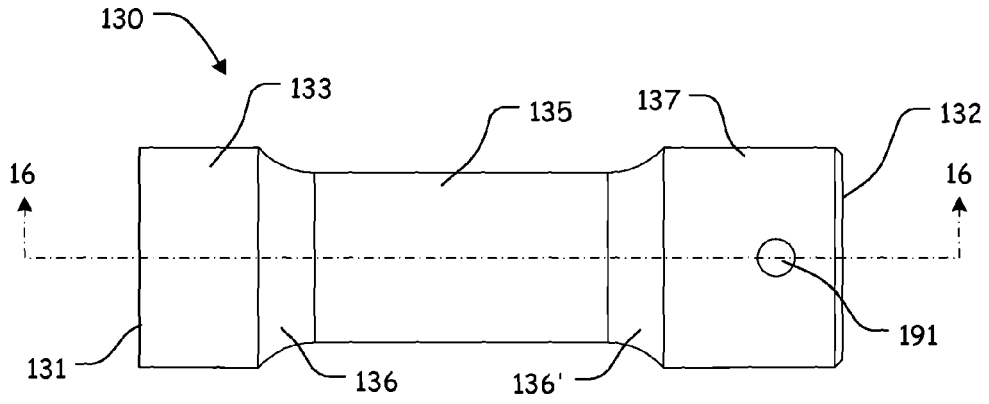
FIG. 14 illustrates a top view of an exemplary embodiment of a buffer element, according to the presently disclosed systems, methods, and/or apparatuses.
Figure 15:
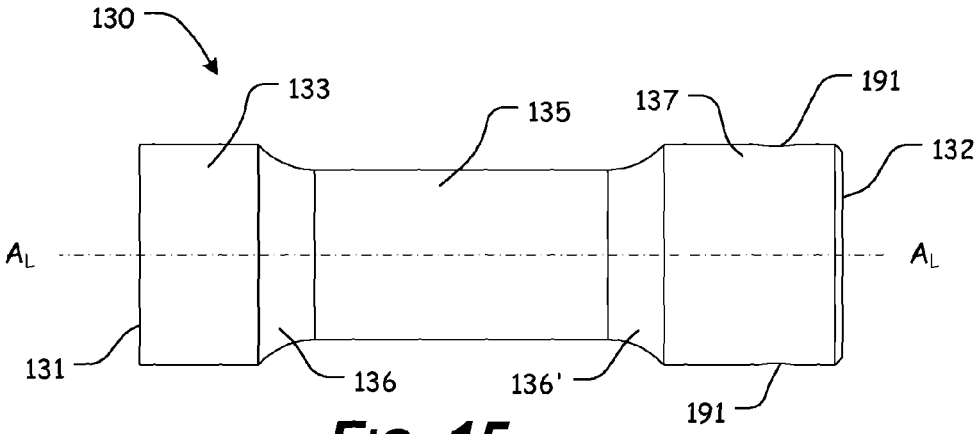
FIG. 15 illustrates a side view of an exemplary embodiment of a buffer element, according to the presently disclosed systems, methods, and/or apparatuses.
Figure 16:
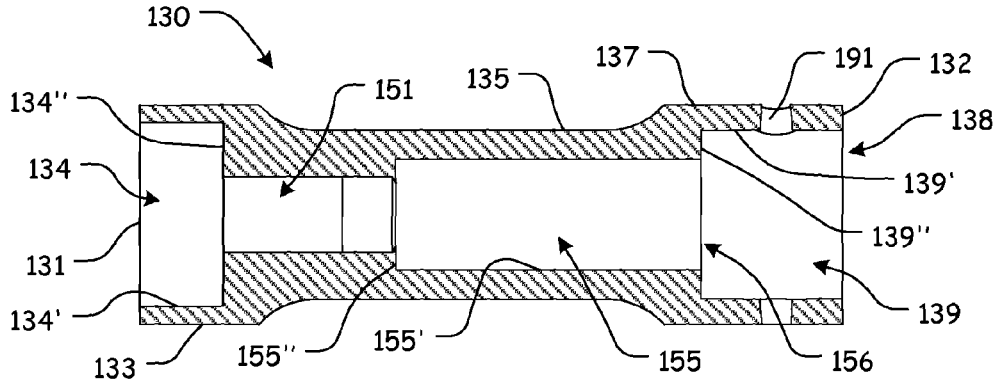
FIG. 16 illustrates a cross-sectional view taken along line 16-16 of the buffer tube of FIG. 14, according to the presently disclosed systems, methods, and/or apparatuses.
Figure 17:
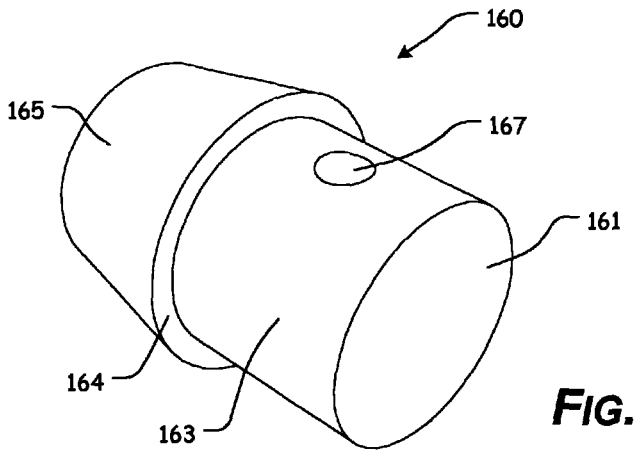
FIG. 17 illustrates an upper, front perspective view of an exemplary embodiment of a bumper, according to the presently disclosed systems, methods, and/or apparatuses.
Figure 18:
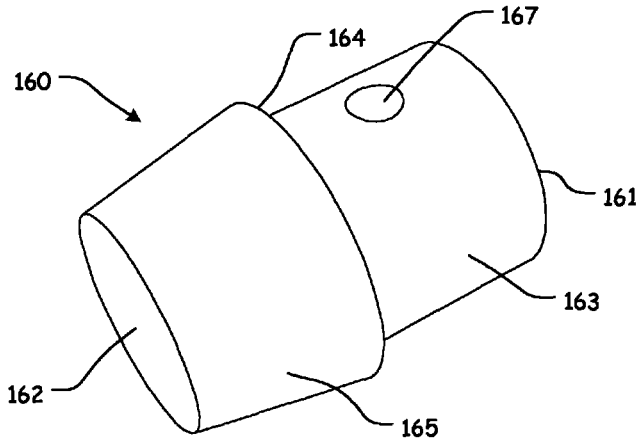
FIG. 18 illustrates an upper, rear perspective view of an exemplary embodiment of a bumper, according to the presently disclosed systems, methods, and/or apparatuses.
Figure 19:
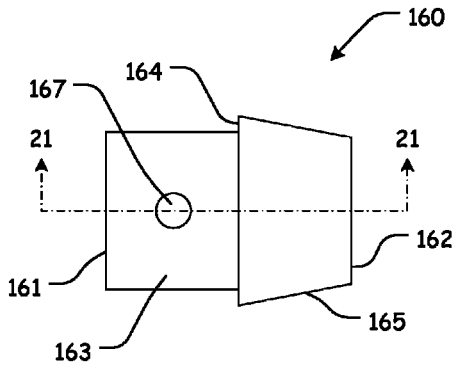
FIG. 19 illustrates a top view of an exemplary embodiment of a bumper, according to the presently disclosed systems, methods, and/or apparatuses.
Figure 20:
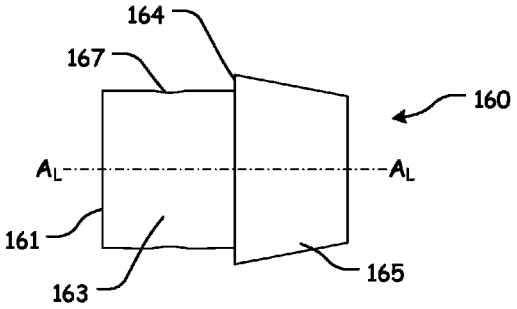
FIG. 20 illustrates a side view of an exemplary embodiment of a bumper, according to the presently disclosed systems, methods, and/or apparatuses.
Figure 21:
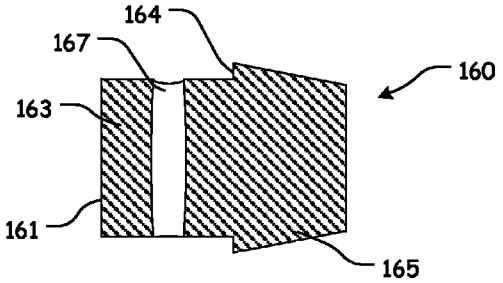
FIG. 21 illustrates a cross-sectional view taken along line 21-21 of the bumper of FIG. 19, according to the presently disclosed systems, methods, and/or apparatuses.
Figure 22:
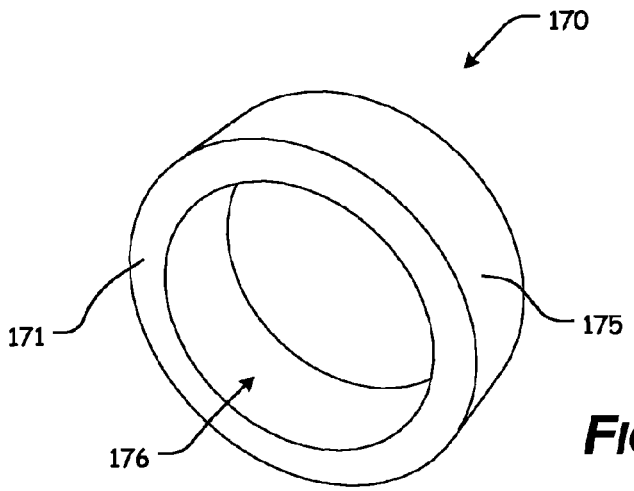
FIG. 22 illustrates an upper, front perspective view of an exemplary embodiment of a spacer, according to the presently disclosed systems, methods, and/or apparatuses.
Figure 23:
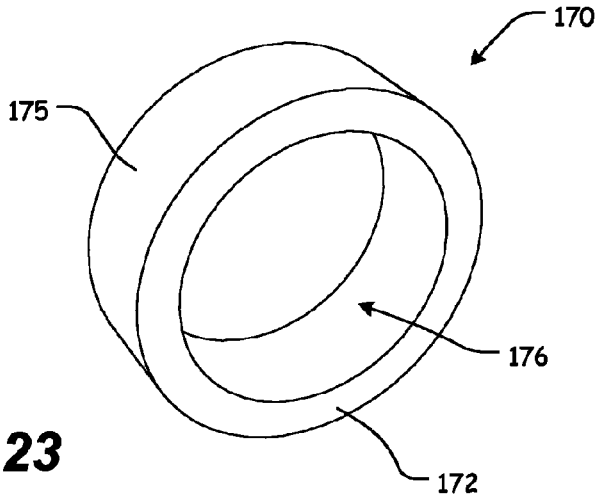
FIG. 23 illustrates an upper, rear perspective view of an exemplary embodiment of a spacer, according to the presently disclosed systems, methods, and/or apparatuses.
Figure 24:
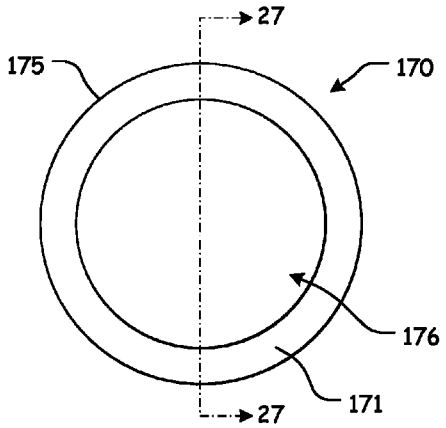
FIG. 24 illustrates a front view of an exemplary embodiment of a spacer, according to the presently disclosed systems, methods, and/or apparatuses.
Figure 25:
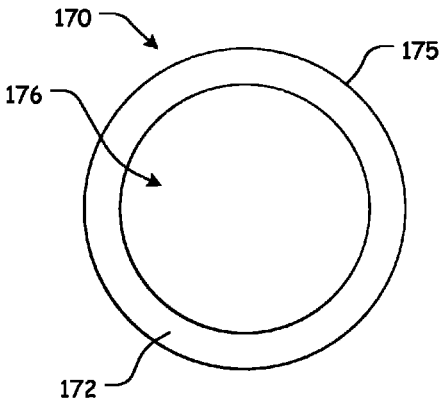
FIG. 25 illustrates a rear view of an exemplary embodiment of a spacer, according to the presently disclosed systems, methods, and/or apparatuses.
Figure 26:
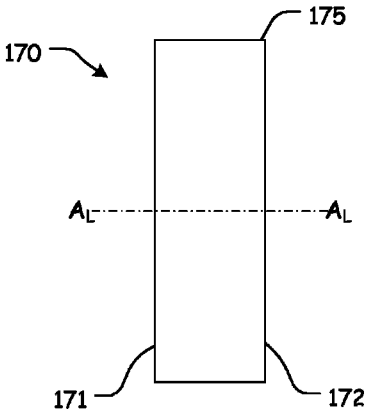
FIG. 26 illustrates a side view of an exemplary embodiment of a spacer, according to the presently disclosed systems, methods, and/or apparatuses.
Figure 27:
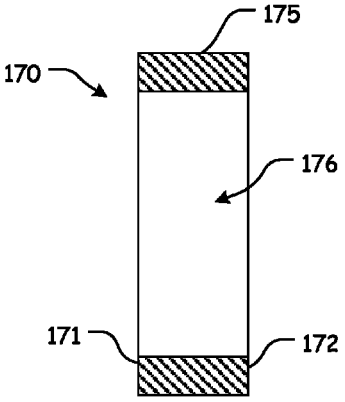
FIG. 27 illustrates a cross-sectional view taken along line 27-27 of the spacer of FIG. 24, according to the presently disclosed systems, methods, and/or apparatuses.
Figure 28:
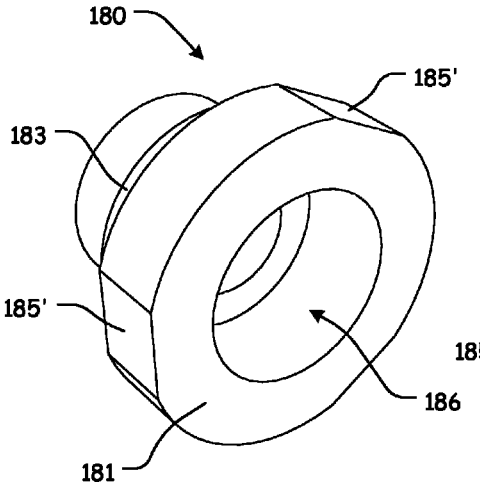
FIG. 28 illustrates an upper, front perspective view of an exemplary embodiment of a collar, according to the presently disclosed systems, methods, and/or apparatuses.
Figure 29:
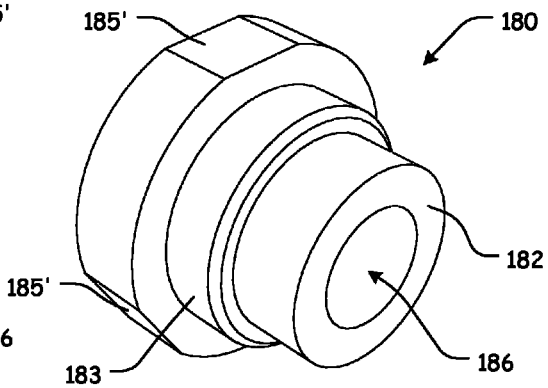
FIG. 29 illustrates an upper, rear perspective view of an exemplary embodiment of a collar, according to the presently disclosed systems, methods, and/or apparatuses.
Figure 30:
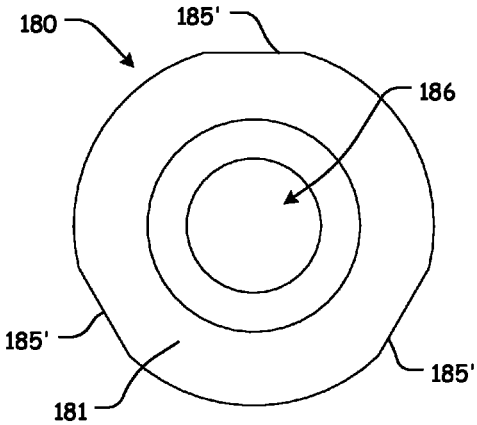
FIG. 30 illustrates a front view of an exemplary embodiment of a collar, according to the presently disclosed systems, methods, and/or apparatuses.
Figure 31:
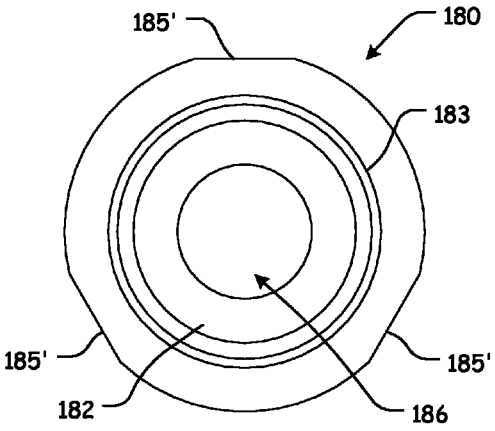
FIG. 31 illustrates a rear view of an exemplary embodiment of a collar, according to the presently disclosed systems, methods, and/or apparatuses.
Figure 32:
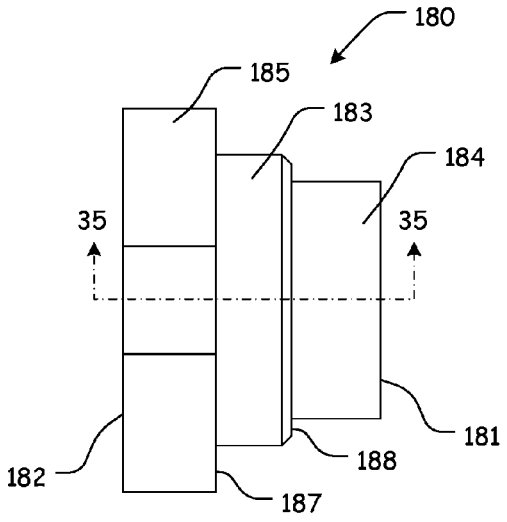
FIG. 32 illustrates a top view of an exemplary embodiment of a collar, according to the presently disclosed systems, methods, and/or apparatuses.
Figure 33:
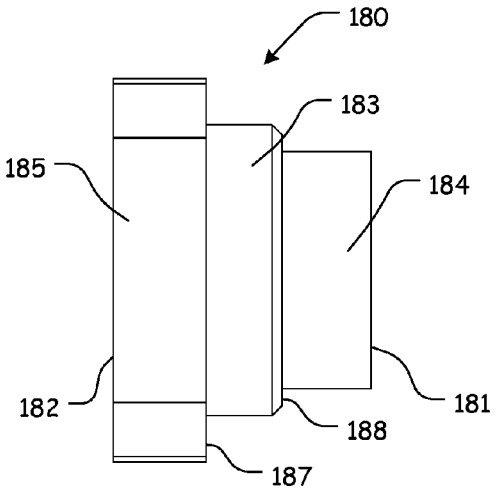
FIG. 33 illustrates a bottom view of an exemplary embodiment of a collar, according to the presently disclosed systems, methods, and/or apparatuses.
Figure 34:
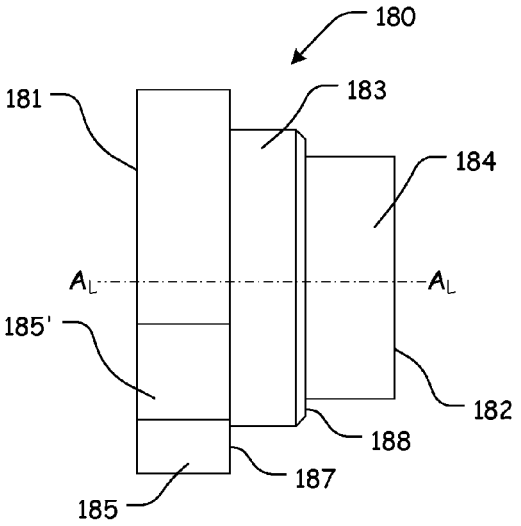
FIG. 34 illustrates a side view of an exemplary embodiment of a collar, according to the presently disclosed systems, methods, and/or apparatuses.
Figure 35:
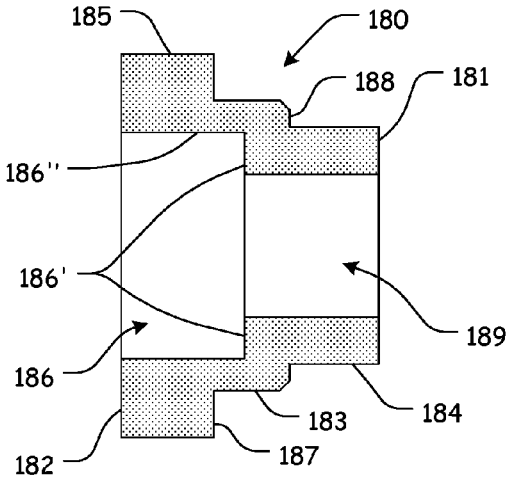
FIG. 35 illustrates a cross-sectional view taken along line 35-35 of the collar of FIG. 32, according to the presently disclosed systems, methods, and/or apparatuses.
Figure 36:
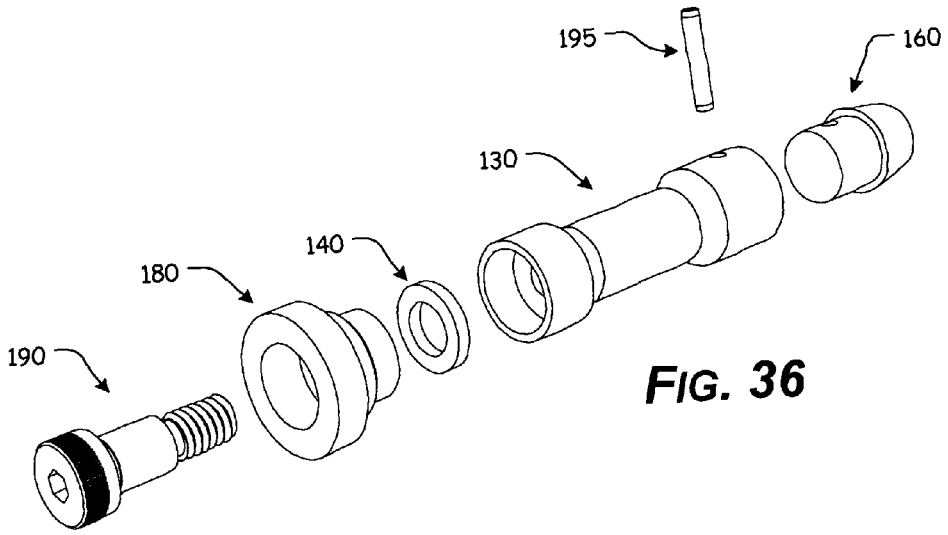
FIG. 36 illustrates a front, perspective, exploded view of certain exemplary components of an exemplary embodiment of a buffer element, according to the presently disclosed systems, methods, and/or apparatuses.
Figure 37:
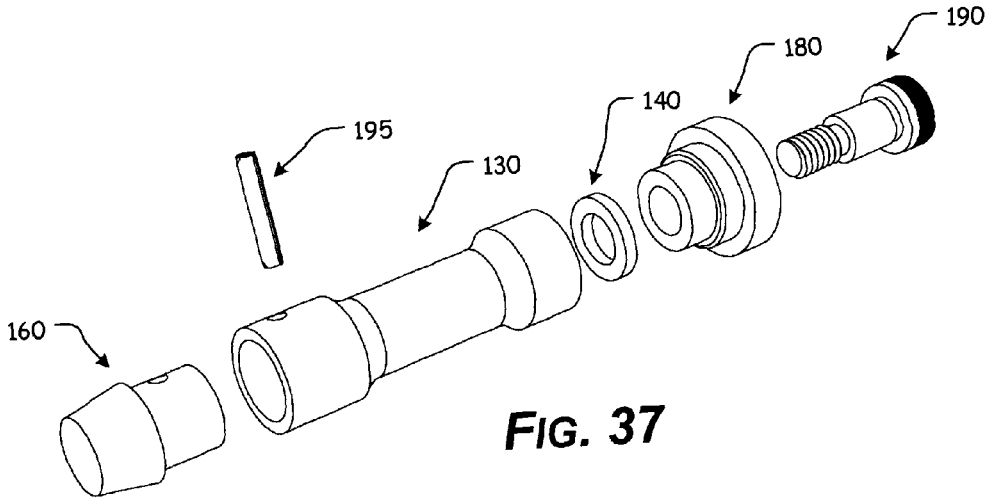
FIG. 37 illustrates a rear, perspective, exploded view of certain exemplary components of an exemplary embodiment of the buffer element of FIG. 36, according to the presently disclosed systems, methods, and/or apparatuses.
Figure 38:
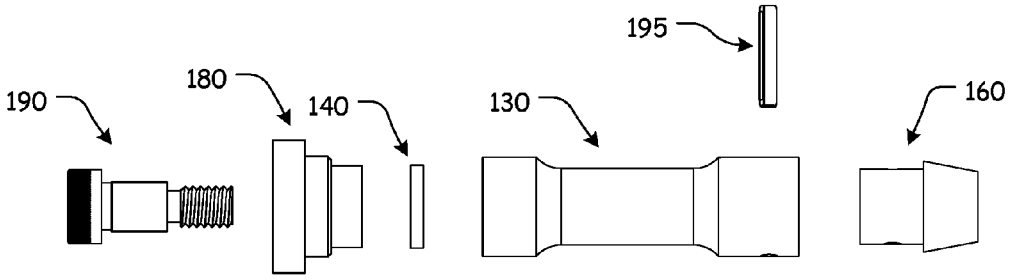
FIG. 38 illustrates a side, exploded view of certain exemplary components of an exemplary embodiment of a buffer element, according to the presently disclosed systems, methods, and/or apparatuses.
Figure 39:
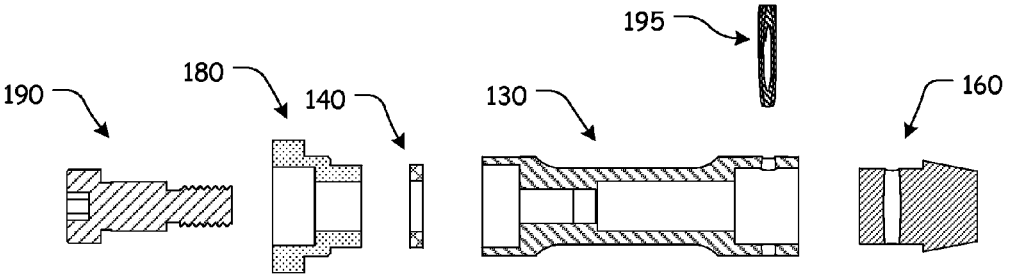
FIG. 39 illustrates a side, cross-sectional, exploded view of certain exemplary components of an exemplary embodiment of the buffer element of FIG. 38, according to the presently disclosed systems, methods, and/or apparatuses.
Figure 40:
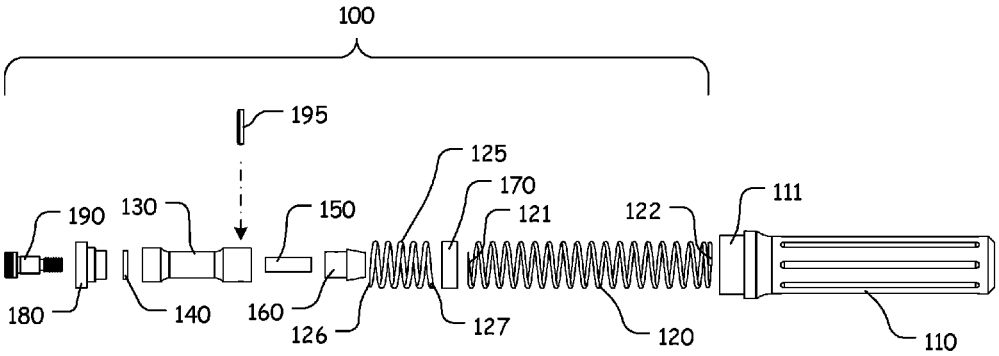
FIG. 40 illustrates a side, exploded view of certain exemplary components of an optional exemplary embodiment of a recoil buffer system, according to the presently disclosed systems, methods, and/or apparatuses.
Figure 41:
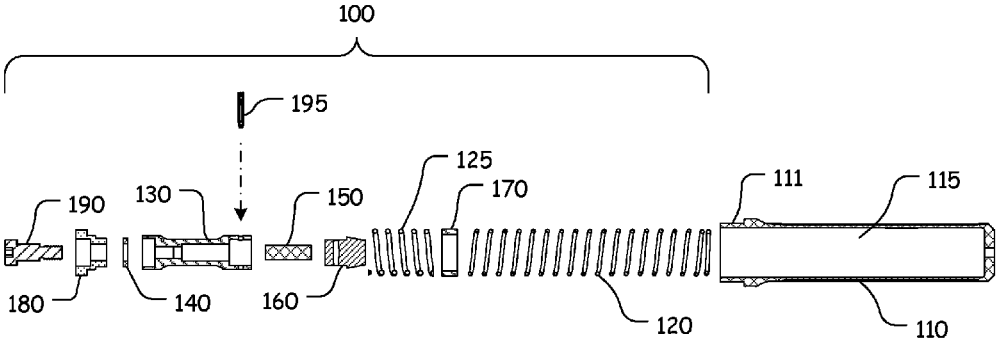
FIG. 41 illustrates a side, cross-sectional, exploded view of certain exemplary components of an optional exemplary embodiment of the recoil buffer system of FIG. 40, according to the presently disclosed systems, methods, and/or apparatuses.
Figure 42:
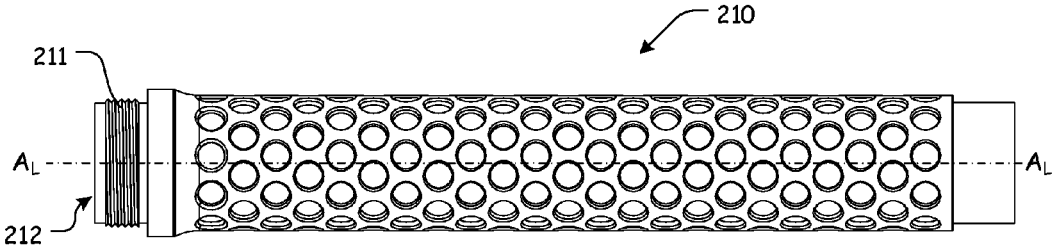
FIG. 42 illustrates a side view of an exemplary embodiment of a buffer tube that may optionally be utilized in connection with the presently disclosed systems, methods, and/or apparatuses.
Figure 43:
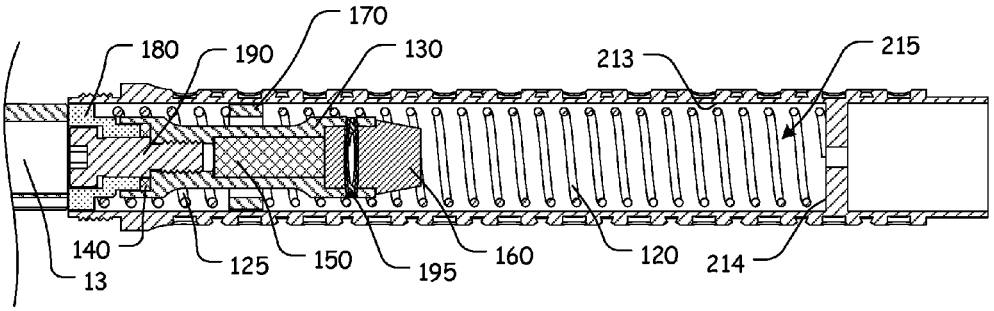
FIG. 43 illustrates a side, cross-sectional view of certain exemplary components of an exemplary embodiment of a recoil buffer system, assembled according to the presently disclosed systems, methods, and/or apparatuses, wherein the components are in a normal, beginning/end of recoil cycle position.
Figure 44:
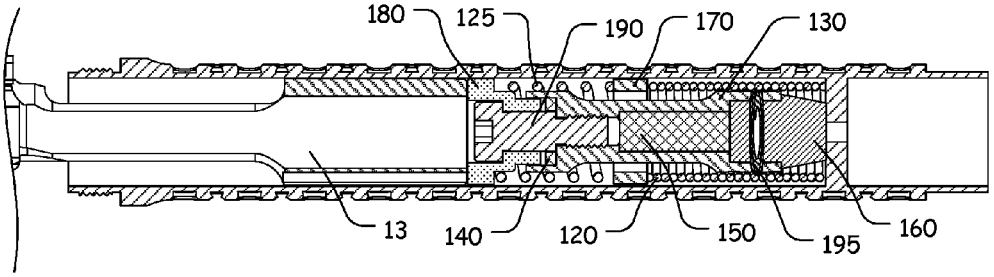
FIG. 44 illustrates a side, cross-sectional view of certain exemplary components of an exemplary embodiment of a recoil buffer system, assembled according to the presently disclosed systems, methods, and/or apparatuses, wherein the second recoil spring is in a compressed position.
Figure 45:
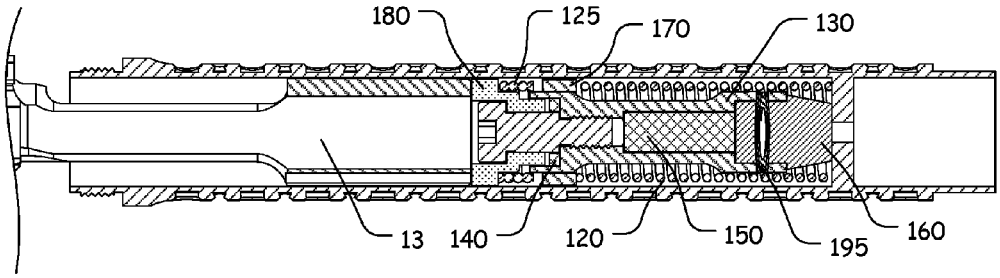
FIG. 45 illustrates a side, cross-sectional view of certain exemplary components of an exemplary embodiment of a recoil buffer system, assembled according to the presently disclosed systems, methods, and/or apparatuses, wherein the second recoil spring is in a compressed position and the first recoil spring is in a compressed position.
Figure 46:
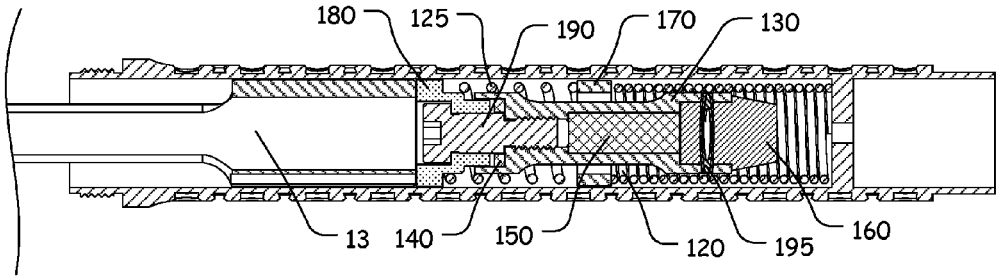
FIG. 46 illustrates a side, cross-sectional view of certain exemplary components of an exemplary embodiment of a recoil buffer system, assembled according to the presently disclosed systems, methods, and/or apparatuses, wherein the second recoil spring is in a compressed position and the first recoil spring is in an expanded or expanding position.
Figure 47:
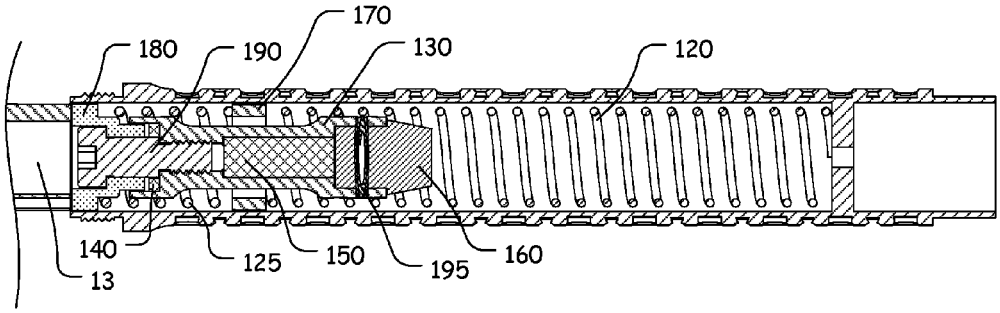
FIG. 47 illustrates a side, cross-sectional view of certain exemplary components of an exemplary embodiment of a recoil buffer system, assembled according to the presently disclosed systems, methods, and/or apparatuses, wherein the second recoil spring is in an expanded or expanding position and the first recoil spring is in an expanded or expanding position.

For simplicity and clarification, the design factors and operating principles of the recoil buffer system according to the presently disclosed systems, methods, and/or apparatuses are explained with reference to various exemplary embodiments of a recoil buffer system according to the presently disclosed systems, methods, and/or apparatuses. The basic explanation of the design factors and operating principles of the recoil buffer system is applicable for the understanding, design, and operation of the recoil buffer system of the presently disclosed systems, methods, and/or apparatuses. It should be appreciated that the recoil buffer system can be adapted to many applications where a recoil buffer system can be used.

As used herein, the word "may" is meant to convey a permissive sense (i.e., meaning "having the potential to"), rather than a mandatory sense (i.e., meaning "must"). Unless stated otherwise, terms such as "first" and "second" are used to arbitrarily distinguish between the elements such terms describe. Thus, these terms are not necessarily intended to indicate temporal or other prioritization of such elements.

The term "coupled", as used herein, is defined as connected, although not necessarily directly, and not necessarily mechanically. The terms "a" and "an" are defined as one or more unless stated otherwise.

Throughout this application, the terms "comprise" (and any form of comprise, such as "comprises" and "comprising"), "have" (and any form of have, such as "has" and "having"), "include", (and any form of include, such as "includes" and "including") and "contain" (and any form of contain, such as "contains" and "containing") are used as open-ended linking verbs. It will be understood that these terms are meant to imply the inclusion of a stated element, integer, step, or group of elements, integers, or steps, but not the exclusion of any other element, integer, step, or group of elements, integers, or steps. As a result, a system, method, or apparatus that "comprises", "has", "includes", or "contains" one or more elements possesses those one or more elements but is not limited to possessing only those one or more elements. Similarly, a method or process that "comprises", "has", "includes" or "contains" one or more operations possesses those one or more operations but is not limited to possessing only those one or more operations.

It should also be appreciated that the terms "recoil buffer system", "buffer assembly", "lower receiver", and "firearm" are used for basic explanation and understanding of the operation of the presently disclosed systems, methods, and/or apparatuses. Therefore, the terms "recoil buffer system", "buffer assembly", "lower receiver", and "firearm" are not to be construed as limiting the systems, methods, and/or apparatuses of the present disclosure. Thus, for example, the term "lower receiver" is to be understood to broadly include any upper, lower, or combined receiver for a firearm or other similar handheld or shoulder mounted device or tool.

For simplicity and clarification, the recoil buffer system of the present disclosure will be described as being used in conjunction with a firearm, such as an AR-15 or M4 style rifle or carbine. However, it should be appreciated that these are merely exemplary embodiments of the recoil buffer system and are not to be construed as limiting the presently disclosed systems, methods, and/or apparatuses. Thus, the recoil buffer system of the present disclosure may be utilized in conjunction with any firearm or rifle, such as, for example, an AR-10 style rifle, air rifle, paintball marker, Airsoft rifle, replica rifle, or any other tool, device, or object.

Turning now to the drawing FIGS., as discussed above, FIG. 1-4 illustrate various components of known buffer tubes. FIGS. 5-49 illustrate certain elements and/or aspects of an exemplary embodiment of the recoil buffer system 100, according to the presently disclosed systems, methods, and/or apparatuses. In illustrative, non-limiting embodiment(s) of the present disclosure, the recoil buffer system 100 comprises at least some of a first recoil spring 120, a second recoil spring 125, a buffer element 130, an internal washer 140, an optional weight element 150, a bumper 160, a spacer 170, a collar 180, and a shoulder bolt 190.

In certain exemplary, nonlimiting embodiments, the recoil buffer system 100 is used in conjunction with a receiver extension or buffer tube 110 or a receiver extension or buffer tube 210.

As illustrated most clearly in FIGS. 5-9, the exemplary receiver extension or buffer tube 110 comprises an elongate portion of material extending, along a longitudinal axis $A_L$, from a first end to a second end and having a substantially cylindrical internal cavity 115 defined by one or more side walls 113 and a bottom wall 114. The internal cavity 115 extends from the bottom wall 114, along the one or more side walls 113, to an open end 112.

In various exemplary embodiments, the buffer tube 110 includes an externally threaded portion 111, which extends from the first end. The externally threaded portion 111, if included, allows the buffer tube 110 to be threadedly attached or connected to the lower receiver 10, via interaction of the externally threaded portion 111 of the buffer tube 110 and an internally threaded buffer tube receiving aperture 11 of the lower receiver 10.

Alternatively, the portion of the buffer tube 110 represented by the externally threaded portion 111 may comprise a smooth or textured surface that allows the buffer tube 110 to be welded or adhesively attached or coupled to a corresponding buffer tube receiving aperture of a lower receiver. Thus, the buffer tube 110 may be attached, connected, or coupled to a lower receiver in any desired manner. In still other exemplary embodiments, the buffer tube 110 may be formed as an integral component of a lower receiver.

In various exemplary, nonlimiting embodiments, the overall length of the buffer tube 110 is substantially shorter than known, typical buffer tubes 5. Similarly, the depth of the internal cavity 115 of the buffer tube 110 is substantially less than known, typical buffer tubes 5. In these exemplary embodiments, the buffer tube 110 can be utilized in conjunction with, for example, retractable buttstocks that provide a shorter overall length to the buttstock assembly and/or firearm. Alternatively, the buffer tube 110 can be utilized in conjunction with certain pistol configurations to provide a shorter overall length to the firearm.

In other exemplary, nonlimiting embodiments, the overall length of the buffer tube 110 is substantially similar to that of known, typical buffer tubes 5. Likewise, the depth of the internal cavity 115 is substantially similar to that of known, typical buffer tubes 5.

In various exemplary embodiments, the buffer tube 110 is substantially rigid and is formed of aluminum. Alternate materials of construction of the buffer tube 110 may include one or more of the following: steel, stainless steel, titanium, and/or other metals, as well as various alloys and composites thereof, glass-hardened polymers, polymeric composites, polymer or fiber reinforced metals, carbon fiber or glass fiber composites, continuous fibers in combination with thermoset and thermoplastic resins, chopped glass or carbon fibers used for injection molding compounds, laminate glass or carbon fiber, epoxy laminates, woven glass fiber laminates, impregnate fibers, polyester resins, epoxy resins, phenolic resins, polyimide resins, cyanate resins, high-strength plastics, nylon, glass, or polymer fiber reinforced plastics, thermoform and/or thermoset materials, and/or various combinations of the foregoing. Thus, it should be understood that the material or materials used to form the buffer tube 110 is a design choice based on the desired appearance and/or functionality of the buffer tube 110.

It should be appreciated that certain elements of the recoil buffer system 100 may be formed as an integral unit (such as, for example, the buffer element 130 and the collar 180). Alternatively, suitable materials can be used and sections or elements made independently and attached or coupled together, to form the various elements of the recoil buffer system 100.

FIGS. 42-49, include illustrations of an exemplary embodiment of a buffer tube 210, according to the presently disclosed systems, methods, and/or apparatuses. As shown in FIGS. 42-49, the buffer tube 210 comprises an elongate portion of material extending, along a longitudinal axis $A_L$, from a first end to a second end and having a substantially cylindrical internal cavity 215, extending from an open end 212 and defined by one or more side walls 213 and a bottom wall 214, and an externally threaded portion 211.

It should be understood that each of these elements of the buffer tube 110 corresponds to and operates similarly to the substantially cylindrical internal cavity 115, the open end 112, the one or more side walls 113, the bottom wall 114, and the externally threaded portion 111, as described herein with reference to the hinged buffer tube 110 of FIGS. 5-9 and 40-41.

However, as shown in FIGS. 42-49, the buffer tube 210 comprises a dimpled or patterned exterior surface. Additionally, the bottom wall 214 is spaced a distance from the second end of the buffer tube 210. As illustrated, an additional internal cavity 217 extends from the second end of the buffer tube 210. By positioning the bottom wall 214 at a desired location, a depth of the internal cavity 115 can be defined within the buffer tube 210, without affecting or dictating the overall length of the buffer tube 210. Thus, for example, the buffer tube 210 may be formed so as to have substantially the same length as a standard buffer tube, while having an internal cavity 215 that has a depth that is less than that of a standard buffer tube.

It should also be appreciated that while the buffer tubes 110 and 210 are illustrated as being substantially cylindrical and not including a key protrusion 7 extending from the buffer tube 110 or 210, each of the buffer tubes 110 or 210 may, in certain exemplary embodiments, include a key protrusion or similar structure. In this manner, the buffer tubes 110 and/or 210 may optionally interact with a known retractable buttstock.

As illustrated most clearly in FIGS. 10-16 and 36-41, the buffer element 130 comprises an elongate portion of material that extends, along a longitudinal axis $A_L$, from a first end 131 to a second end 132.

In certain exemplary embodiments, the buffer element 130 has a consistent shape or diameter extending from the first end 131 to the second end 132. Alternatively, a buffer element body portion 135 is formed between the first end 131 and the second end 132. If included, the buffer element body portion 135 defines an area of the buffer element 130 having a reduced or different cross-sectional shape or diameter. In exemplary embodiments including the buffer element body portion 135, a first buffer element extension portion 133 is formed between the first end 131 of the buffer element 130 and the buffer element body portion 135 and a second buffer element extension portion 137 is formed between the second end 132 of the buffer element 130 and the buffer element body portion 135.

In various exemplary embodiments, an outer surface of each of the first buffer element extension portion 133 and the second buffer element extension portion 137 extends substantially parallel to the longitudinal axis $A_L$, of the buffer element 130. Similarly, in various exemplary embodiments, an outer surface of the buffer element body portion 135 extends substantially parallel to the longitudinal axis $A_L$, of the buffer element 130.

In various exemplary embodiments, an outer diameter or size of each of the first buffer element extension portion 133 and the second buffer element extension portion 137 is larger than an outer diameter or size of the buffer element body portion 135. In exemplary embodiments, the outer diameter, profile, and/or size of the first buffer element extension portion 133 and the second buffer element extension portion 137 are identical or substantially similar.

If the outer diameter or size of each of the first buffer element extension portion 133 and the second buffer element extension portion 137 is larger than an outer diameter or size than an outer diameter or size of the buffer element body portion 135, transition surfaces 136 and 136' may be formed so as to provide a transition between the buffer element body portion 135 and first buffer element extension portion 133 and the second buffer element extension portion 137, respectively.

A transition surface 136 may optionally be provided between the first buffer element extension portion 133 and the buffer element body portion 135. If included, the transition surface 136 provides a substantially smooth or radiused transition between the first buffer element extension portion 133 and the buffer element body portion 135. Similarly, a transition surface 136' may optionally be provided between the second buffer element extension portion 137 and the buffer element body portion 135, which provides a substantially smooth or radiused transition between the second buffer element extension portion 133 and the buffer element body portion 135.

In various exemplary embodiments, the overall exterior profile of the buffer element 130, when viewed from the front or rear, is substantially circular. It should be appreciated that the overall profile of the buffer element 130 may comprise for example, an overall profile substantially resembling that of an oval, triangle, square, pentagon, hexagon, heptagon, octagon, star shape, or other desired shape.

Regardless of the overall shape or profile of the buffer element 130, the outer diameter or extent of the buffer element 130 is such that the buffer element 130 fits within and is slidable within at least a portion of the first recoil spring 120 and/or at least a portion of the second recoil spring 125.

In various exemplary embodiments, the buffer element 130 includes a bumper cavity 139 extending from the second end 132 and defined by one or more side walls 139' and a bottom wall or shoulder 139". The bumper cavity 139 extends from the bottom wall or shoulder 139", along the one or more side walls 139', to a second open end 138 of the buffer element 130.

In various exemplary embodiments, an internal buffer element cavity 155 is optionally formed so as to extend from the bumper cavity 139. The internal buffer element cavity 155 is defined by one or more side walls 155' and a bottom wall or shoulder 155". The internal buffer element cavity 155 extends from the bottom wall or shoulder 155", along the one or more side walls 155', to at least one open end 156.

If included, the internal buffer element cavity 155 may optionally be formed so as to receive a weight element 150 therein. Alternatively, the overall size and shape of the buffer element cavity 155 may be altered so as to provide a specifically sized and shaped buffer element cavity 155 for receipt of a weight element 150 therein. In still other exemplary embodiments, the buffer element cavity 155 may be provided with a desired size or shape so as to provide a specific weight or mass to the buffer element 130. Thus, it should be appreciated that the entire buffer element 130 provides a reciprocating mass.

If utilized, the weight element 150 is generally substantially cylindrical in shape and is sized so as to be fitted within the internal buffer element cavity 155 of the buffer element 130. The actual weight of the weight element 150 can vary, depending upon the desired functionality of the weight element 150 and the overall functional weight of the buffer element 130. In various exemplary embodiments, the weight element 150 may comprise a portion of stainless steel or tungsten rod. Alternatively, the weight element 150 may comprise a powdered or other form of material to provide a desired amount of solid, slidable, or movable material within the internal buffer element cavity 155.

In various exemplary embodiments, a buffer element retaining pin aperture 191 extends at least partially through the buffer element 130, proximate the second end 132 of the buffer element 130. The buffer element retaining pin aperture 191 is formed so as to accept at least a portion of a retaining pin 195 therethrough. As illustrated, the buffer element retaining pin aperture 191 may optionally extend through opposing side walls within a portion of the bumper cavity 139 and the second buffer element extension portion 137.

In various exemplary, nonlimiting embodiments, the buffer element 130 does not include a bumper cavity 139 (or an internal buffer element cavity 155). In these exemplary, nonlimiting embodiments, the manufacturing time and cost of the buffer element 130 reduced. Furthermore, a buffer element 130 that does not include a bumper cavity 139 (or an internal buffer element cavity 155) may be formed so as to provide sufficient weigh to be close to the reciprocating mass of a standard, MIL-SPEC carbine buffer.

In various exemplary embodiments, the buffer element 130 includes a collar cavity 134 extending from the first end 131 and defined by one or more side walls 134' and a bottom wall or shoulder 134". The collar cavity 134 extends from the bottom wall or shoulder 134", along the one or more side walls 134', to a first open end of the buffer element 130.

In various exemplary embodiments, an internally threaded portion 151 is formed so as to extend from the collar cavity 134. The internally threaded portion 151 is defined at least by an internally threaded portion that is formed and internally threaded so as to interact with external threads of a shoulder bolt 190. Thus, interaction of the external threads of the shoulder bolt 190 and the threaded portion of the internally threaded portion 151 allow the shoulder bolt to be threadedly attached or connected to the buffer element 130.

In various exemplary embodiments, the buffer element 130 is substantially rigid and is formed of stainless steel. Alternate materials of construction of the buffer element 130 may include one or more of the following: steel, aluminum, titanium, and/or other metals, as well as various alloys and composites thereof. Thus, it should be understood that the material or materials used to form the buffer element 130 is a design choice based on the desired appearance and/or functionality of the buffer element 130.

As illustrated most clearly in FIGS. 17-21 and 36-39, the bumper 160 comprises a portion of material extending, along a longitudinal axis $A_L$, from a first end 161 to a second end 162. In various exemplary embodiments, a bumper extension portion 163 extends from the first end 161. The bumper extension portion 163 extends from the first end 161 to a bumper shoulder 164. In various exemplary embodiments, the bumper extension portion 163 extends substantially parallel to the longitudinal axis $A_L$, of the bumper 160 and the bumper shoulder 164 extends perpendicular to the longitudinal axis $A_L$, of the bumper 160. Alternatively, the bumper shoulder 164 may extend at an angle that is equal to, greater than, or less than 90° relative to the longitudinal axis $A_L$, of the bumper 160.

The outer size and shape of the bumper extension portion 163 is such that at least a portion of the bumper extension portion 163 can be fitted through the second open end 138 of the bumper cavity 139 and positioned within at least a portion of the bumper cavity 139.

A bumper head portion 165 extends from the bumper shoulder 164 to the second end 162. In various exemplary embodiments, the bumper head portion 165 has an overall dome or a tapered shape. Alternatively, the bumper head portion 165 may comprise a generally cylindrical overall shape.

In various exemplary embodiments, the bumper head portion 165 has a larger maximum outer diameter or size than an outer diameter or size of the bumper extension portion 163. Thus, the bumper shoulder 164 provides a transition between the bumper head portion 165 and the bumper extension portion 163.

A bumper retaining aperture 167 extends at least partially through the bumper extension portion 163 and is formed so as to accept at least a portion of a retaining pin 195 therethrough.

In various exemplary embodiments, the bumper 160 is substantially rigid and is formed of urethane. Alternatively, the bumper 160 may be substantially resilient, temporarily deformable, or flexible and alternate materials of construction of the bumper 160 may include one or more of rubber, silicone, or plastic, and/or various combinations or variations of the foregoing. Thus, it should be understood that the material or materials used to form the bumper 160 is a design choice based on the desired appearance and/or functionality of the bumper 160.

As illustrated most clearly in FIGS. 22-27 and 36-39, the spacer 170 comprises a portion of material extending, along a longitudinal axis $A_L$, from a first end 171 to a second end 172. A spacer aperture 176 is formed through the spacer 170, along the longitudinal axis $A_L$.

The spacer aperture 176 is formed so as to accept at least a portion of the buffer element 130 therein, such that the spacer 170 is slidable along at least a portion of the buffer element 130.

The spacer 170 has an outer surface 175 that is formed so as to be received within the internal cavity 115 of the buffer tube 110 (or the internal cavity 215 of the buffer tube 210). Thus, when the spacer 170 is slidably fitted about the buffer element 130, the spacer 170 is slidable relative to the internal cavity 115 of the buffer tube 110 (or the internal cavity 215 of the buffer tube 210) and the buffer element 130.

The first end 171 to a second end 172 are sized and shaped so as to provide abutment surfaces for the first recoil spring 120 and the second recoil spring 125.

In various exemplary embodiments, the overall exterior profile of the spacer 170, when viewed from the front or rear, is substantially circular. It should be appreciated that the overall profile of the spacer 170 may comprise for example, an overall profile substantially resembling that of an oval, triangle, square, pentagon, hexagon, heptagon, octagon, star shape, or other desired shape.

Regardless of the overall shape or profile of the spacer 170, the outer diameter or extent of the spacer 170 is such that the spacer 170 fits within and is slidable within the internal cavity 115 of the buffer tube 110 (or the internal cavity 215 of the buffer tube 210).

In various exemplary embodiments, the spacer 170 is substantially rigid and is formed of stainless steel. Alternate materials of construction of the spacer 170 may include one or more of the following: steel, aluminum, titanium, and/or other metals, as well as various alloys and composites thereof. Thus, it should be understood that the material or materials used to form the spacer 170 is a design choice based on the desired appearance and/or functionality of the spacer 170.

As illustrated most clearly in FIGS. 28-39, the collar 180 comprises a portion of material extending, along a longitudinal axis $A_L$, from a first end 181 to a second end 182. A collar aperture 189 is formed through the collar 180, substantially along the longitudinal axis $A_L$. The collar aperture 189 is formed so as to accept at least a portion of the shoulder bolt 190 therein, such that the collar 180 is slidable along at least a portion of the shaft of the shoulder bolt 190.

A collar body head portion 185 extends from a first portion of a central collar body portion 183 and a collar body extension portion 184 extends from a second portion of the central collar body portion 183.

In various exemplary embodiments, collar body head portion 185 has an outer shape or diameter that is greater than an outer shape or diameter of the collar body portion 183. A collar shoulder 187 extends between an outer surface of the collar body head portion 185 and an outer surface of the collar body portion 183. In various exemplary embodiments, a surface of the collar shoulder 187 is formed substantially perpendicular to the longitudinal axis $A_L$, of the collar 180. Alternatively, the surface of the collar shoulder 187 may extend at an angle that is greater than or less than 90° relative to the longitudinal axis $A_L$, of the collar 180. The collar shoulder 187 is sized and shaped so as to provide an abutment surface for the second recoil spring 125, while the central collar body portion 183 is sized and shaped so as to be at least partially fitted within the second recoil spring 125.

The collar body extension portion 184 has an outer shape or diameter that is less than an outer shape or diameter of the collar body portion 183 and is formed so as to be at least partially slidably received within the collar cavity 134 of the buffer element 130.

A collar extension shoulder 188 extends between an outer surface of the collar body extension portion 184 and an outer surface of the collar body portion 183. The collar extension shoulder 188 is sized and shaped so as to provide an abutment surface for the first end 131 of the buffer element 130.

In certain exemplary embodiments, the collar body head portion 185 has a substantially circular outer profile, when viewed from the front or rear. In various exemplary embodiments, one or more grooves, notches, or flats 185' are formed at various locations around the collar body head portion 185.

If included, the flats 185' may optionally reduce the overall weight of the collar 180, provide less friction to the collar 180, and/or provide areas for dirt, debris, or other material to pass by portions of the collar 180. It should be appreciated that the overall profile of the collar body head portion 185 (and the collar 180) may comprise for example, an overall profile resembling that of a circle, triangle, square, pentagon, hexagon, heptagon, octagon, star shape, or other desired shape.

Regardless of the overall outer shape or profile of the collar body head portion 185 (or the collar 180), the outer diameter or extent of the collar 180 is such that the collar 180 fits within and is slidable within the internal cavity 115 of the buffer tube 110 (or the internal cavity 215 of the buffer tube 210).

A substantially cylindrical collar recess 186 extends from the first end 181 and is defined by one or more side walls 186' and a bottom wall or shoulder 186". The collar recess 186 extends from the bottom wall or shoulder 186", along the one or more side walls 186', to a first open end of the collar 180 and has a diameter that is greater than a diameter of the collar aperture 189. The collar recess 186 is formed so as to accept at least a portion of the head of the shoulder bolt 190 therein, such that while the collar 180 is slidable along at least a portion of the shaft of the shoulder bolt 190 the head of the shoulder bolt 190 limits the movement of the collar 180 at least by interaction of the head of the shoulder bolt 190 and the bottom wall or shoulder 186".

In various exemplary embodiments, the collar 180 is substantially rigid and is formed of stainless steel. Alternate materials of construction of the collar 180 may include one or more of the following: steel, aluminum, titanium, and/or other metals, as well as various alloys and composites thereof, glass-hardened polymers, polymeric composites, polymer or fiber reinforced metals, carbon fiber or glass fiber composites, continuous fibers in combination with thermoset and thermoplastic resins, chopped glass or carbon fibers used for injection molding compounds, laminate glass or carbon fiber, epoxy laminates, woven glass fiber laminates, impregnate fibers, polyester resins, epoxy resins, phenolic resins, polyimide resins, cyanate resins, high-strength plastics, nylon, glass, or polymer fiber reinforced plastics, thermoform and/or thermoset materials, and/or various combinations of the foregoing. Thus, it should be understood that the material or materials used to form the collar 180 is a design choice based on the desired appearance and/or functionality of the collar 180.

The internal washer 140, if included, has an outer diameter that allows the internal washer 140 to be fitted within the collar cavity 134 of the buffer element 130 and an inner diameter that allows at least a portion of the shoulder bolt 190 to slidably pass through the internal washer 140. In various exemplary embodiments, the internal washer 140, if included, acts as an additional cushion or dampener between the surface of the first end 181 of the collar 180 and the bottom wall or shoulder 134" of the buffer element 130.

The first recoil spring 120 extends from a first end 121 to a second end 122, while the second recoil spring 125 extends from a first end 126 to a second end 127. In various exemplary embodiments, the first recoil spring 120 comprises a standard AR buffer spring, having a reduced length. In certain exemplary, nonlimiting embodiments, the first recoil spring 120 comprises a standard AR buffer spring that has been shortened.

In certain exemplary embodiments, the second recoil spring 125 has an outer diameter and an inner diameter that are substantially similar to the outer diameter and inner diameter of the first recoil spring 120.

In certain exemplary embodiments, the first recoil spring 120 and the second recoil spring 125 may constitute separate portions of a continuous spring that is cut, at some point along its overall length, to form the separate first recoil spring 120 and second recoil spring 125.

In certain exemplary embodiments, the overall spring characteristics of the first recoil spring 120 and the second recoil spring 125 are substantially similar. Alternatively, the second recoil spring 125 may optionally have certain spring characteristics, such as, for example, a spring rate or spring biasing force, which are different from the spring characteristics of the first recoil spring 120. For example, the second recoil spring 125 may optionally have a spring rate or spring biasing force that is greater than a spring rate or spring biasing force of the first recoil spring 120. In still other exemplary embodiments, the second recoil spring 125 may optionally have a spring rate or spring biasing force that is equal to a spring rate or spring biasing force of the first recoil spring 120. Thus, it should be appreciated that the spring rates or spring biasing forces of the second recoil spring 125 and the first recoil spring 120 may be the same or may be different from one another.

Thus, it should be appreciated that the overall size and characteristics of the first recoil spring 120 and the second recoil spring 125 are designed choices based upon the desired performance of the first recoil spring 120 and the second recoil spring 125.

In certain exemplary embodiments, the combined spring rate or spring biasing force of the first recoil spring 120 and the second recoil spring 125 is approximately equivalent to the spring biasing force of a standard, MIL-SPEC carbine buffer spring rate or spring biasing force. Alternatively, the spring rate or spring biasing force of each of the first recoil spring 120 and the second recoil spring 125 may be different from one another and specific spring rates for one or both of the first recoil spring 120 and the second recoil spring 125 may be selected to adjust or "tuned" certain characteristics of the firearm, such as, for example, the actual or perceived to recoil produced during a firing cycle or the dwelt time or cyclic rate of the firearm.

As illustrated most clearly in FIGS. 36-49, the various components of the buffer assembly 100 are fitted together and are illustrated as being utilized in conjunction with a buffer tube 110 or a buffer tube 210. As illustrated, during assembly of the components of the buffer element 130, the weight element 150, is optionally inserted within the internal buffer element cavity 155. At least a portion of the bumper extension portion 163 is fitted through the second open end 138 of the bumper cavity 139 and positioned within at least a portion of the bumper cavity 139, such that the bumper retaining aperture 167 is aligned with the buffer element retaining pin aperture 191 and the bumper shoulder 164 optionally contacts the second end 132 of the buffer element 130.

Once the bumper 160 is appropriately positioned proximate the second end 132 of the buffer element 130, the retaining pin 195 is positioned through the buffer element retaining pin aperture 191 and extends at least partially through the bumper retaining aperture 167. In certain exemplary embodiments, the retaining pin 195 is positioned through at least a portion of the buffer element retaining pin aperture 191 on a first side of the second buffer element extension portion 137, extends completely through the bumper retaining aperture 167, and extends through at least a portion of the buffer element retaining pin aperture 191 on a second side of the second buffer element extension portion 137.

The internal washer 140, if included, is fitted within the collar cavity 134 of the buffer element 130 such that the internal washer 140 contacts the bottom wall or shoulder 134" of the collar cavity 134.

The collar 180 is slidably positioned relative to the buffer element 130 such that at least a portion of the collar body extension portion 184 is slidably received within at least a portion of the collar cavity 134. Once appropriately positioned, the shoulder bolt 190 is used to slidably attach or couple the collar 180 to the buffer element 130 via interaction of the threaded portion of the shoulder bolt 190 and the internally threaded portion 151 of the buffer element 130.

When the constituent elements of the buffer element 130 are appropriately attached or coupled together, the assembled components of the buffer element 130 can be positioned within the internal cavity 115 or 215 of the buffer tube 110 or 210, respectively.

During positioning of the assembled buffer element 130 within the buffer tube 110 or 210, the first recoil spring 120 is positioned within the internal cavity 115 or 215. The first recoil spring 120 is positioned within the internal cavity 115 or 215 such that the second end 122 of the first recoil spring 120 is in contact with the bottom wall 114 or 214 of the internal cavity 115 or 215.

The second recoil spring 125 is slidably fitted about the assembled buffer element 130, such that the first end 126 of the recoil spring 125 contacts the collar shoulder 187 of the collar 180.

The spacer 170 is slidably fitted about the assembled buffer element 130, such that the first end 171 of the spacer 170 engages or contacts the second end 127 of the second recoil spring 125. In this manner, the second recoil spring 125 is slidably captured between the collar shoulder 187 of the collar 180 and the first end 171 of the spacer 170.

At least a portion of the assembled buffer element 130 is then slidably fitted within the first recoil spring 120, such that the first end 121 of the first recoil spring 120 engages or contacts the second end 172 of the spacer 170.

During a firing cycle, as most clearly illustrated in FIGS. 43-47, as the bolt carrier 13 is driven rearward, the rear of the bolt carrier 13 contacts the second end 182 of the collar 180 and urges the collar 180 rearward, toward the bottom wall 114 or 214 of the buffer tube 110 or 210. The rearward force exerted on the collar 180 initially urges the collar 180 and, in turn, the buffer element 130 rearward, within the interior cavity 115 of the buffer tube 110.

In certain exemplary embodiments, when the various components of the buffer element 130 are assembled, a gap is initially present between the first end 181 of the collar 180 and the internal washer 140 (and/or the bottom wall or shoulder 134" of the buffer element 130). At some point during the firing cycle, as the collar 180 is urged rearward (by the rearward motion of the bolt carrier 13), the collar 180 slides rearward, along the shoulder bolt 190, until the gap is reduced or eliminated. In certain exemplary embodiments, the collar 180 slides rearward, along the shoulder bolt 190, until the first end 181 of the collar 180 contacts the internal washer 140. Depending upon the resilient properties of the internal washer 140, the contact between the first end 181 of the collar 180 and the internal washer 140 may provide additional dampening or reduction in recoil. The degree of movement of the collar 180 relative to the buffer element 130 can be adjusted based upon the resilient spring biasing force provided by the internal washer 140, the first recoil spring 120, and/or the second recoil spring 125.

In certain exemplary embodiments, as the bolt carrier 13 continues to be driven rearward, the resilient spring biasing force of the second recoil spring 125 continues to maintain the spacer 170 substantially in its position relative to the buffer element 130 and the resilient spring biasing force of the first recoil spring 120 is overcome, such that the first recoil spring 120 begins to compress, as the bolt carrier 130 continues rearward.

At some point, as the bolt carrier 13 continues to be driven rearward, the resilient spring biasing force of the second recoil spring 125 is also overcome, such that the second recoil spring 125 begins to compress. It should be appreciated that the point at which the resilient spring biasing force of each of the first recoil spring 120 and the second recoil spring 125 is overcome may be altered, depending upon the selected spring biasing force of the first recoil spring 120 and the second recoil spring 125. Therefore, the spring biasing force of each recoil spring may be selected so that the spring biasing force of the first recoil spring 120 is overcome before the spring biasing force of the second recoil spring 125 or so that the spring biasing force of the second recoil spring 125 is overcome before the spring biasing force of the first recoil spring 120 is overcome.

Thus, it should be understood that one or both of the first recoil spring 120 and the second recoil spring 125 may be partially or fully compressed when the bolt carrier group reaches its rearmost position.

When the bolt carrier group reaches its rearmost position, the first recoil spring 120 provides spring biasing force to the second and 172 of the spacer 170, urging the spacer 170 forward, and the second recoil spring 125 provides spring biasing force to the collar shoulder 187 of the collar 180, urging the collar 180 and the buffer element 130 forward. The assembled buffer element 130 is urged forward with enough force to drive the bolt carrier 13 forward, toward the chamber, initiating chambering of the waiting round from the magazine into the chamber.

Each of the elements of the assembled buffer element 130 contributes to the reciprocating mass, or "dead blow" effect provided by the buffer assembly 100.

Figure 48:
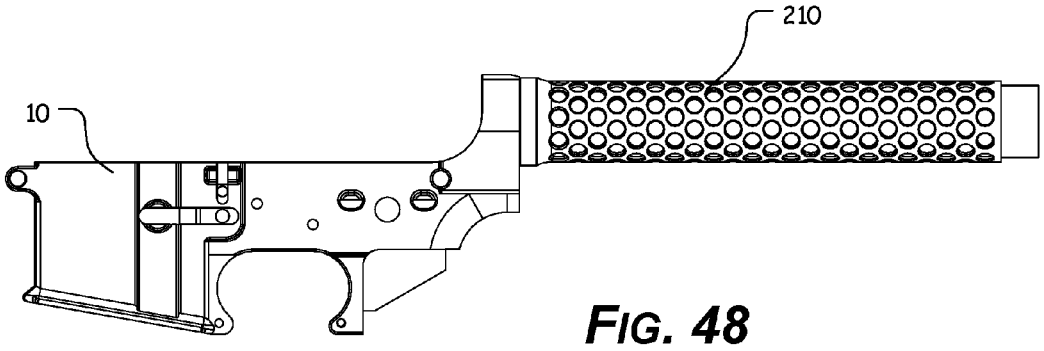
FIG. 48 illustrates a left, side view of an exemplary embodiment of a recoil buffer system being assembled together with a lower receiver, according to the presently disclosed systems, methods, and/or apparatuses.
Figure 49:
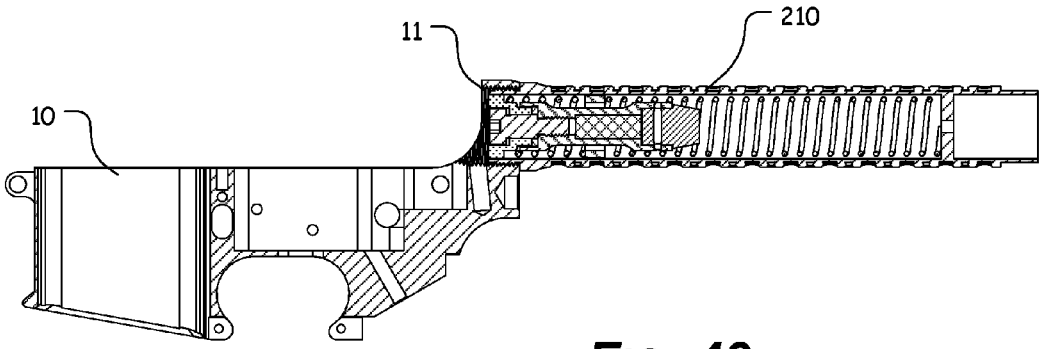
FIG. 49 illustrates a left, side cross-sectional view of certain exemplary components of an exemplary embodiment of a recoil buffer system being assembled together with a lower receiver, according to the presently disclosed systems, methods, and/or apparatuses.

As illustrated most clearly in FIGS. 48-49, the recoil buffer system 100 is illustrated as being utilized in conjunction with a lower receiver 10 and, further, being threadedly connected to the lower receiver 10 via interaction of an externally threaded portion 211 of the buffer tube to 10 and an internally threaded buffer tube receiving aperture 11 of the lower receiver 10. It should be appreciated that the lower receiver 10 can be a typical lower receiver for a firearm. It should also be appreciated that a more detailed explanation of the lower receiver 10, the standard features and elements of a receiver that are not related to the present disclosure, instructions regarding how to assemble the lower receiver 10, and certain other items and/or techniques necessary for the implementation and/or operation of the various exemplary embodiments of the present disclosure are not provided herein because such elements are commercially available and/or such background information will be known to one of ordinary skill in the art. Therefore, it is believed that the level of description provided herein is sufficient to enable one of ordinary skill in the art to understand and practice the present disclosure, as described.

It should also be understood that while the elements of the recoil buffer system 100 of the present disclosure are described as being utilized in conjunction with a first recoil spring 120 and a second recoil spring 125, the present disclosure is not limited to solely being utilized with a first recoil spring 120 and a second recoil spring 125. Thus, the recoil buffer system 100 of the present disclosure may operably be utilized with a single recoil spring.

While the presently disclosed systems, methods, and/or apparatuses have been described in conjunction with the exemplary embodiments outlined above, the foregoing description of exemplary embodiments of the present disclosure, as set forth above, are intended to be illustrative, not limiting and the fundamental systems, methods, and/or apparatuses should not be considered to be necessarily so constrained. It is evident that the systems, methods, and/or apparatuses are not limited to the particular variation or variations set forth and many alternatives, adaptations modifications, and/or variations will be apparent to those skilled in the art.

Furthermore, where a range of values is provided, it is understood that every intervening value, between the upper and lower limit of that range and any other stated or intervening value in that stated range is encompassed within the presently disclosed systems, methods, and/or apparatuses. The upper and lower limits of these smaller ranges may independently be included in the smaller ranges and is also encompassed within the present disclosure, subject to any specifically excluded limit in the stated range. Where the stated range includes one or both of the limits, ranges excluding either or both of those included limits are also included in the present disclosure.

It is to be understood that the phraseology of terminology employed herein is for the purpose of description and not of limitation. Unless defined otherwise, all technical and scientific terms used herein have the same meaning as commonly understood by one of ordinary skill in the art to which the presently disclosed systems, methods, and/or apparatuses belong.

In addition, it is contemplated that any optional feature of the inventive variations described herein may be set forth and claimed independently, or in combination with any one or more of the features described herein.

Accordingly, the foregoing description of exemplary embodiments will reveal the general nature of the presently disclosed systems, methods, and/or apparatuses, such that others may, by applying current knowledge, change, vary, modify, and/or adapt these exemplary, non-limiting embodiments for various applications without departing from the spirit and scope of the present disclosure and elements or methods similar or equivalent to those described herein can be used in practicing the present disclosure. Any and all such changes, variations, modifications, and/or adaptations should and are intended to be comprehended within the meaning and range of equivalents of the disclosed exemplary embodiments and may be substituted without departing from the true spirit and scope of the presently disclosed systems, methods, and/or apparatuses.

Also, it is noted that as used herein and in the appended claims, the singular forms "a", "and", "said", and "the" include plural referents unless the context clearly dictates otherwise. Conversely, it is contemplated that the claims may be so-drafted to require singular elements or exclude any optional element indicated to be so here in the text or drawings. This statement is intended to serve as antecedent basis for use of such exclusive terminology as "solely", "only", and the like in connection with the recitation of claim elements or the use of a "negative" claim limitation(s).

What is claimed is:

1. A recoil buffer system configured for a firearm buffer tube, comprising:

a first recoil spring, wherein said first recoil spring extends from a first end of said first recoil spring to a second end of said first recoil spring;

a second recoil spring, wherein said second recoil spring extends from a first end of said second recoil spring to a second end of said second recoil spring;

a buffer element, wherein said buffer element extends from a first buffer element end to a second buffer element end, wherein said buffer element includes a collar cavity extending from said first buffer element end, wherein an internally threaded portion extends from said collar cavity, wherein said internally threaded portion is internally threaded so as to interact with external threads of a shoulder bolt, such that interaction of said external threads of said shoulder bolt and said threaded portion of said internally threaded portion allow said shoulder bolt to be threadedly attached or connected to said buffer element;

a spacer, wherein said spacer extends from a first spacer end to a second spacer end, wherein said spacer comprises a spacer aperture formed therethrough, where said spacer aperture is formed so as to accept at least a portion of said buffer element therein, such that said spacer is slidable along at least a portion of said buffer element, and wherein said first spacer end and said second spacer end provide abutment surfaces for said first recoil spring and said second recoil spring; and a collar, wherein said collar extends from a first collar end to a second collar end, wherein a collar aperture is formed through said collar, wherein said collar aperture is formed so as to accept at least a portion of said shoulder bolt therein, such that said collar is slidable along at least a portion of a shaft of said shoulder bolt, wherein a collar body head portion extends from a first portion of a central collar body portion and a collar body extension portion extends from a second portion of said central collar body portion, wherein said collar body head portion has an outer diameter or shape that is greater than an outer diameter or shape of said collar body portion, wherein a collar shoulder extends between an outer surface of said collar body head portion and an outer surface of said collar body portion, wherein said collar shoulder is sized and shaped so as to provide an abutment surface for said second end of said second recoil spring, while said central collar body portion is sized and shaped so as to be at least partially fitted within said second recoil spring, wherein said collar body extension portion has an outer diameter or shape that is less than an outer diameter or shape of said collar body portion, wherein said collar body extension portion is formed so as to be at least partially slidably received within said collar cavity of said buffer element, and wherein a collar extension shoulder extends between and outer surface of said collar body extension portion and said outer surface of said collar body portion, wherein a collar recess extends from said first collar end, wherein said collar recess has a diameter that is greater than a diameter of said collar aperture, and wherein said collar recess is formed so as to accept at least a portion of a head of said shoulder bolt therein.

2. The recoil buffer system of claim 1, wherein an outer spacer surface of said spacer is formed so as to be received within an internal cavity of a buffer tube, such that when said spacer is slidably fitted about said buffer element, said spacer is also slidable relative to said internal cavity of said buffer tube and slidable relative to said buffer element.

3. The recoil buffer system of claim 1, wherein said buffer element has a consistent diameter or shape extending from said first buffer element end to said second buffer element end.

4. The recoil buffer system of claim 1, further comprising a first buffer element extension portion formed proximate said first buffer element end of said buffer element, a second buffer element extension portion formed proximate said second buffer element end of said buffer element, and a buffer element body portion formed between said first buffer element extension portion and said second buffer element extension portion, wherein said buffer element body portion defines an area of said buffer element having a reduced or different cross-sectional diameter or shape as compared to a cross-sectional diameter or shape of at least one of said first buffer element extension portion and said second buffer element extension portion.

5. The recoil buffer system of claim 4, wherein an outer surface of at least one of said first buffer element extension portion and said second buffer element extension portion extends substantially parallel to a longitudinal axis of said buffer element.

6. The recoil buffer system of claim 4, wherein an outer surface of said buffer element body portion extends substantially parallel to a longitudinal axis of said buffer element.

7. The recoil buffer system of claim 4, wherein an outer diameter or size of each of said first buffer element extension portion and said second buffer element extension portion is greater than an outer diameter or size of said buffer element body portion.

8. The recoil buffer system of claim 4, wherein an outer diameter, profile, and/or size of said first buffer element extension portion and said second buffer element extension portion are identical or substantially similar.

9. The recoil buffer system of claim 1, further comprising a bumper attached or coupled to said second buffer element end of said buffer element.

10. The recoil buffer system of claim 1, further comprising a bumper cavity extending from said second buffer element end, wherein at least a portion of a bumper extension portion is positioned within at least a portion of said bumper cavity.

11. The recoil buffer system of claim 10, further comprising an internal buffer element cavity extending from said bumper cavity, wherein said internal buffer element cavity is formed so as to receive a weight element therein.

12. The recoil buffer system of claim 1, wherein one or more grooves, notches, or flats are formed at various locations around said collar body head portion.

13. The recoil buffer system of claim 1, further comprising an internal washer, wherein said internal washer is fitted within said collar cavity of said buffer element, between an inner wall or shoulder of said collar aperture and said first collar end of said collar, and wherein said internal washer includes a washer aperture formed therethrough, wherein a diameter of said washer aperture allows at least a portion of said shoulder bolt to slidably pass through said internal washer.

14. The recoil buffer system of claim 1, wherein said first recoil spring is longer than said second recoil spring.

15. The recoil buffer system of claim 1, wherein said second recoil spring has an outer diameter and an inner diameter that are substantially similar to an outer diameter and an inner diameter of said first recoil spring.

16. The recoil buffer system of claim 1, wherein a spring rate or spring biasing force of said first recoil spring is substantially similar to a spring rate or spring biasing force of said second recoil spring.

17. The recoil buffer system of claim 1, wherein a spring rate or spring biasing force of said first recoil spring is different from a spring rate or spring biasing force of said second recoil spring.

18. A recoil buffer system configured for a firearm buffer tube, comprising:

a buffer element, wherein said buffer element extends from a first buffer element end to a second buffer element end;

a collar, wherein a collar shoulder extends from a portion of said collar, and wherein said collar is attached or coupled to said first buffer element end so as to be at least partially slidable relative to said buffer element;

a spacer, wherein said spacer extends from a first spacer end to a second spacer end, wherein said spacer is slidable along at least a portion of said buffer element;

a first recoil spring, wherein said first recoil spring extends from a first end of said first recoil spring to a second end of said first recoil spring; and a second recoil spring, wherein said second recoil spring is positioned between said collar shoulder of said collar and said first spacer end of said spacer, and wherein said first recoil spring is positioned such that a first end of said first recoil spring is abutted against said second spacer end of said spacer, and wherein said first recoil spring extends from said second spacer end of said spacer, beyond said second buffer element end of said buffer element.

19. The recoil buffer system of claim 18, wherein a spring rate or spring biasing force of said first recoil spring is different from a spring rate or spring biasing force of said second recoil spring.

20. A recoil buffer system configured for a firearm buffer tube, comprising:

a buffer element, wherein said buffer element extends from a first buffer element end to a second buffer element end;

a collar, wherein a collar shoulder extends from a portion of said collar, and wherein said collar is attached or coupled, via a shoulder bolt, to said first buffer element end, such that said collar is at least partially slidable relative to said buffer element;

a spacer, wherein said spacer extends from a first spacer end to a second spacer end, wherein said spacer is slidable along at least a portion of said buffer element;

at least one first recoil spring, wherein said at least one recoil spring is positioned so as to extend between from said collar shoulder of said collar and said first spacer end of said spacer; and at least one second recoil spring, wherein said at least one second recoil spring is positioned so as to extend from said second spacer end of said spacer, beyond said second buffer element end of said buffer element.

* * * * *